US008807283B2

(12) United States Patent
Shell et al.

(10) Patent No.: US 8,807,283 B2
(45) Date of Patent: Aug. 19, 2014

(54) LIFT APPARATUS

(76) Inventors: Dennis Shell, Webster, MN (US); David Shell, Escondido, CA (US)

( * ) Notice: Subject to any disclaimer, the term of this patent is extended or adjusted under 35 U.S.C. 154(b) by 1080 days.

(21) Appl. No.: 12/684,302

(22) Filed: Jan. 8, 2010

(65) Prior Publication Data

US 2010/0176944 A1 Jul. 15, 2010

Related U.S. Application Data

(60) Provisional application No. 61/143,539, filed on Jan. 9, 2009.

(51) Int. Cl.

| | |
|---|---|
| ***B66B 9/08*** | (2006.01) |
| ***A61G 7/14*** | (2006.01) |
| ***E04F 11/06*** | (2006.01) |
| *A61G 7/10* | (2006.01) |

(52) U.S. Cl.

CPC ..... *B66B 9/0869* (2013.01); *A61G 7/10* (2013.01); *Y10S 414/134* (2013.01)

USPC ..... 187/200; 414/545; 414/921; 182/1

(58) Field of Classification Search

CPC ..... B66B 9/089; A61G 7/10; A61G 7/14; A61G 7/1036; A61G 7/1025

USPC ..... 187/200; 414/545, 921; 182/1, 2.2

IPC ..... B66B 9/08; A61G 7/10, 7/14; E04F 11/06; A61H 3/00

See application file for complete search history.

(56) References Cited

U.S. PATENT DOCUMENTS

| | | | | | |
|---|---|---|---|---|---|
| 501,694 | A | * | 7/1893 | Richards | 182/1 |
| 2,466,708 | A | * | 4/1949 | Kamps | 182/1 |
| 2,551,345 | A | * | 5/1951 | Scott | 52/183 |
| 3,731,761 | A | * | 5/1973 | Glenn | 182/1 |
| 3,912,298 | A | * | 10/1975 | Humphrey | 280/166 |
| 4,176,999 | A | | 12/1979 | Thorley | |
| 4,457,402 | A | | 7/1984 | Del Vecchio et al. | |
| 4,556,128 | A | | 12/1985 | Thorley et al. | |
| 5,105,915 | A | | 4/1992 | Gary | |
| 5,224,723 | A | | 7/1993 | Hatas | |
| 5,234,078 | A | * | 8/1993 | Smith | 187/200 |
| 5,316,432 | A | | 5/1994 | Smalley et al. | |
| 5,425,615 | A | | 6/1995 | Hall et al. | |
| 5,624,009 | A | | 4/1997 | Benjamin et al. | |
| 5,632,357 | A | | 5/1997 | Matre | |
| 5,657,832 | A | * | 8/1997 | Stevens | 182/1 |
| 5,794,292 | A | * | 8/1998 | Ricci, Jr. | 14/69.5 |
| 5,901,813 | A | * | 5/1999 | Orgal | 187/200 |
| 5,937,971 | A | | 8/1999 | Storm | |
| 6,105,726 | A | * | 8/2000 | Taylor et al. | 187/201 |
| 6,648,579 | B2 | | 11/2003 | Vartanian, Sr. | |

(Continued)

FOREIGN PATENT DOCUMENTS

| | | | | |
|---|---|---|---|---|
| DE | 10361919 A1 | * | 8/2005 | B66B 9/08 |
| EP | 1600416 A1 | * | 11/2005 | B66B 9/08 |

*Primary Examiner* — William A Rivera
*Assistant Examiner* — Stefan Kruer

(57) ABSTRACT

A lift apparatus configured to move a passenger platform of the lift apparatus between a first position and an elevated second position. A stairway of the example lift apparatus may be used as a stairway when the passenger platform is arranged in the first position. As the passenger platform is raised to the elevated second position, hinged steps of the stairway are transformed into a horizontal surface.

13 Claims, 21 Drawing Sheets

(56) References Cited

U.S. PATENT DOCUMENTS 6,705,824 B2 3/2004 Ablabutyan et al.
7,234,565 B1 * 6/2007 Lam ..... 187/200
2003/0221916 A1 * 12/2003 Dube et al. ..... 187/391
2005/0217939 A1 * 10/2005 Nielsen et al. ..... 187/200

* cited by examiner

LIFT APPARATUS

CROSS REFERENCE TO RELATED APPLICATIONS

This application claims priority to U.S. Provisional Application Ser. No. 61/143,539 filed on Jan. 9, 2009, entitled LIFT MECHANISM, the disclosure of which is incorporated by reference herein in its entirety.

BACKGROUND

There are various devices that operate to lift individuals or objects from one level or location to another level or location. An example of such a device is an elevator, which typically operates within a dedicated elevator shaft to transport people and objects between different floors of a building. Another example of such a device is an escalator. An escalator typically has a moving platform that forms a moving stairway structure to advance passengers from one floor to another floor of a building. While such devices are useful in certain contexts, they are not practical in other contexts. There is a need for a lift apparatus that overcomes the deficiencies of the prior art.

SUMMARY

In one aspect, an example lift apparatus is disclosed. The example lift apparatus includes a stationary landing section including an elevated landing, at least one support member extending from the stationary landing, and step supports rigidly coupled to at least one support members. The example lift apparatus further includes a platform section including a passenger platform constructed to move between a first position and an elevated second position. The example lift apparatus additionally includes a linkage section pivotally connected to and arranged between the platform section and the landing section, the linkage section comprises a linkage and step plates pivotally connected to the linkage. When the platform section is in the first position, at least some of step plates are supported by the step supports to form a stairway. When the platform section is in the second position, the step plates are pivoted relative to the linkage to collectively form a surface extending between the platform section and the elevated landing.

In another aspect, a method for lowering a passenger platform of a lift apparatus from a first elevated position to a second lowered position is disclosed. The example method includes, in response to receiving an input, directing pressurized fluid contained within an extended cylinder of an actuator through a pressure compensated orifice, the actuator being coupled to a passenger platform through a linkage. The example method additionally includes controlling a predefined rate of retraction of the cylinder with the pressure compensated orifice to lower the passenger platform.

In yet another aspect, a method for installing a lift apparatus is disclosed. The example lift apparatus includes a stationary landing section, a linkage section, and a platform section, in which the landing section includes an elevated landing, a first and second side panel, a plurality of adjustable support feet, and a landing railing, the linkage section includes a linkage, a plurality of step plates hingedly connected to the linkage, and a platform railing, and the platform section includes a passenger platform, a gate, and a platform railing. The method includes positioning the lift apparatus proximate to an installation site, raising and securing a top surface of the elevated landing approximately at a height of an elevated surface of the installation site, and adjusting a height adjustment assembly of each of the plurality of adjustable support feet to position the top surface of the elevated landing approximately level to the elevated surface of the installation site.

This Summary is provided to introduce a selection of concepts, in a simplified form, that are further described below in the Detailed Description. This Summary is not intended to identify key or essential features of the claimed subject matter, nor is it intended to be used in any way to limit the scope of the claimed subject matter.

DESCRIPTION OF THE DRAWINGS

Aspects of the present disclosure may be more completely understood in consideration of the following detailed description of various embodiments in connection with the accompanying drawings.

DETAILED DESCRIPTION

Figure 1:
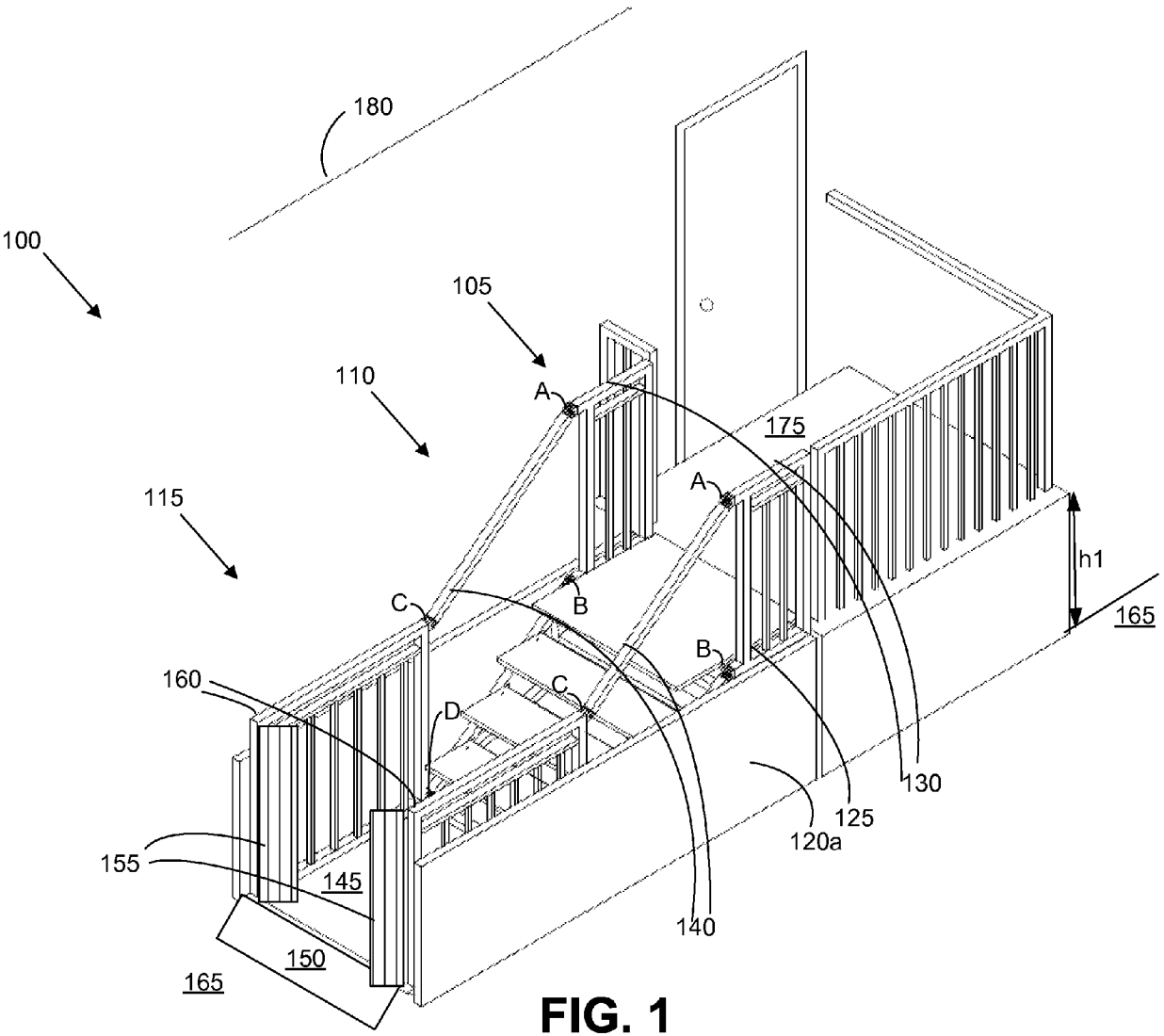
FIG. 1 is a perspective view of an example lift apparatus with a passenger platform arranged in a first position.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The present disclosure relates to a lift apparatus configured to actuate a passenger platform of the lift apparatus between a first position and an elevated second position. In some embodiments, a stairway of the example lift apparatus may be used as any ordinary stairway when the passenger platform is arranged in the first position. As the passenger platform is raised to the elevated second position, hinged steps of the stairway are transformed into a horizontal surface.

FIG. 1 is a perspective view an example lift apparatus 100. The lift apparatus 100 generally includes landing section 105, linkage section 110, and platform section 115. In some embodiments, landing section 105 includes side panels 120 including first side panel 120*a* and second side panel 120*b*, elevated landing 125, and landing railing 130. Landing section 105 is generally hingedly coupled to linkage section 110 at pivot points A and B. Linkage section 110 includes stairway 135 and linkage railing 140. Platform section 115 includes passenger platform 145, ramp 150, gate 155, and platform railing 160. Platform section 115 is generally hingedly coupled to linkage section 110 at pivot points C and D.

While the example lift apparatus 100 is functional as any ordinary stairway, when arranged in the first position it is also configured such that platform section 115 may be raised from support surface 165 until passenger platform 145 reaches height h1 of access area 175 of building 180. In some embodiments, as platform section 115 is raised, gate 155 automatically closes and stairway 135 is transformed into a horizontal surface. Passenger platform 145 remains generally horizontal while raising and lowering.

In some embodiments, the example lift apparatus 100 is constructed to reduce complexity of landing section 105, linkage section 110, and platform section 115. Additionally, the example lift apparatus 100 may be installed as a single unit and generally customized in appearance as desired.

Figure 2:
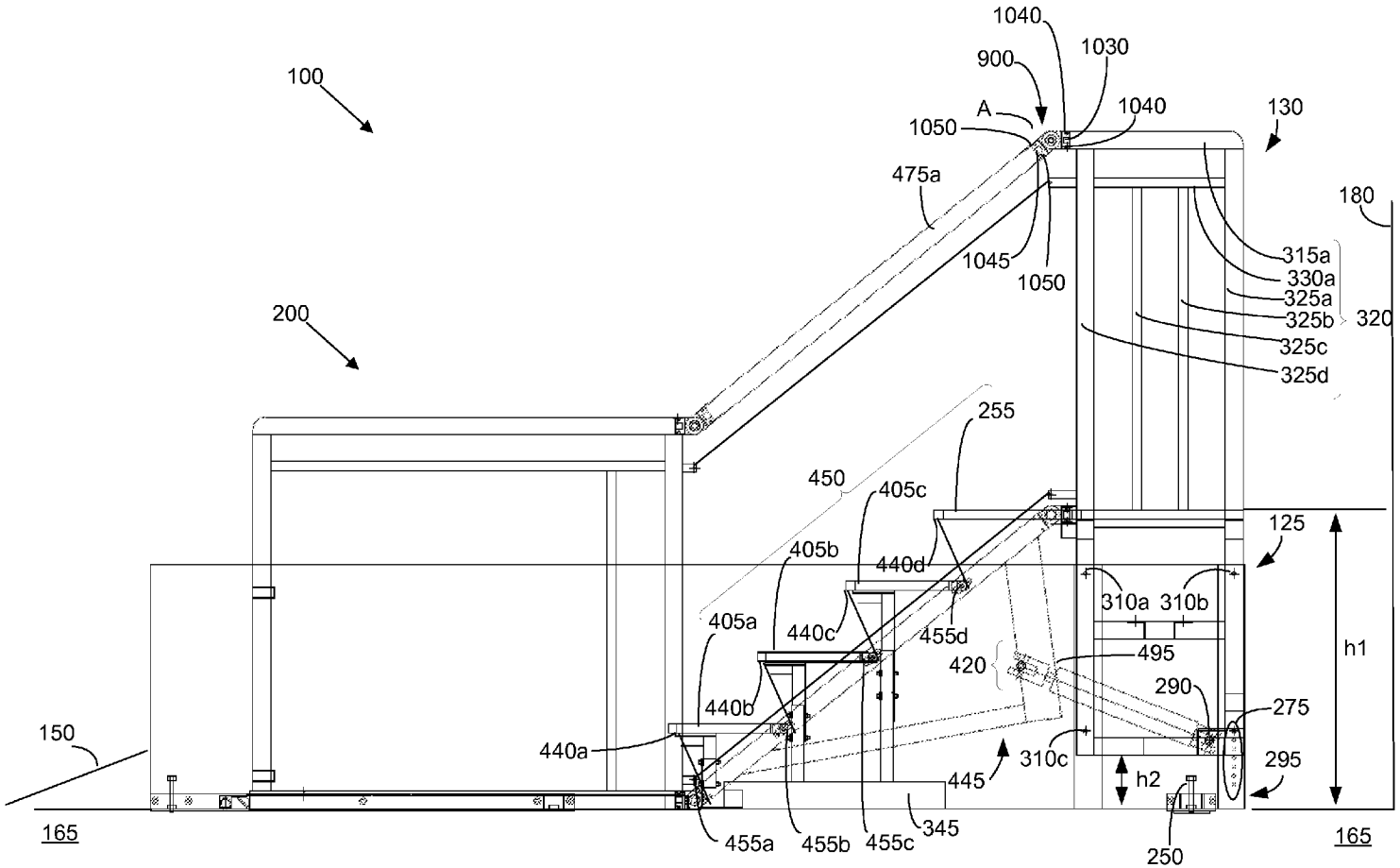
FIG. 2 is a side view of the lift apparatus of FIG. 1.
Figure 3:
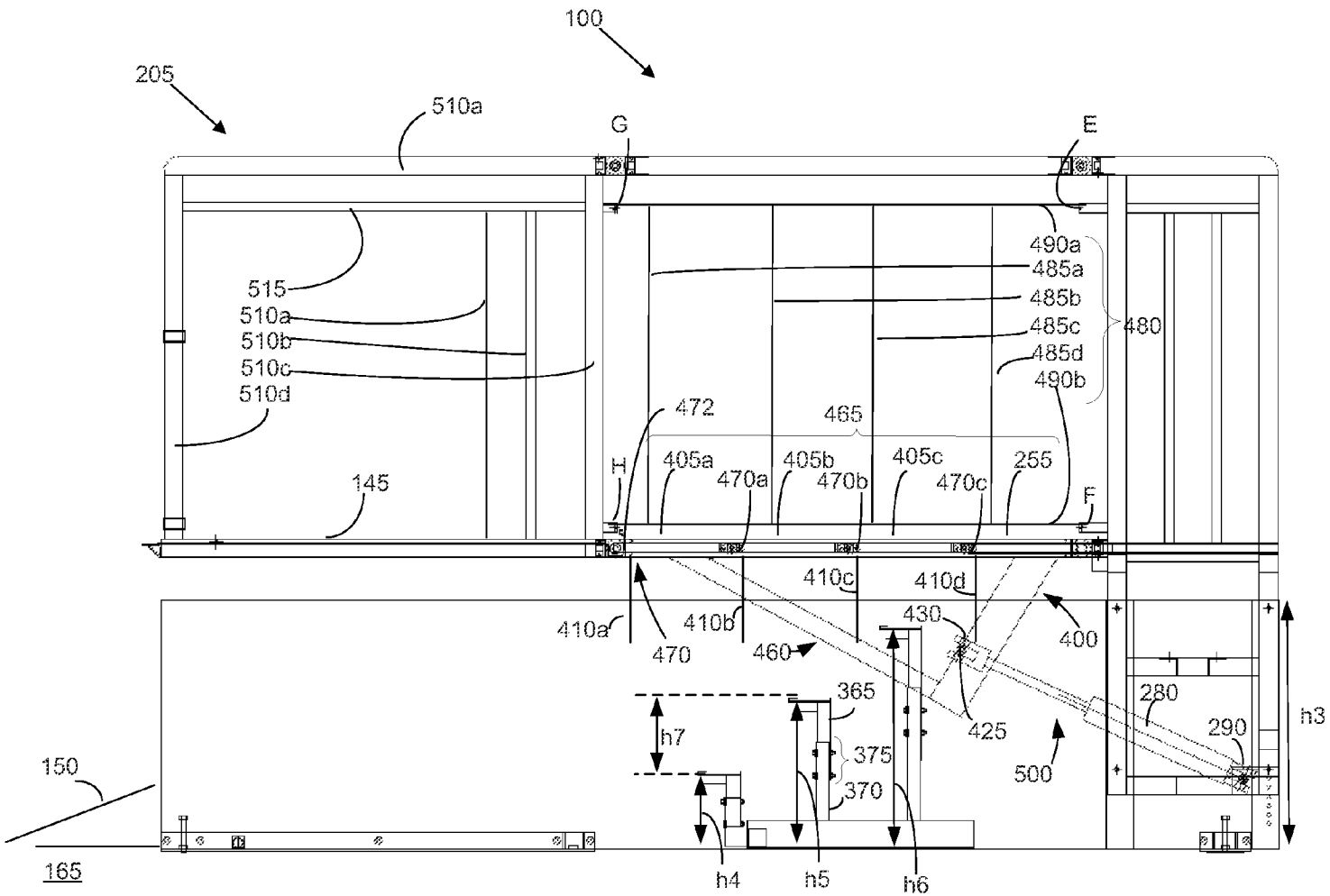
FIG. 3 is a side view of the lift apparatus of FIG. 1 in which the passenger platform is arranged in an elevated second position.
Figure 4:
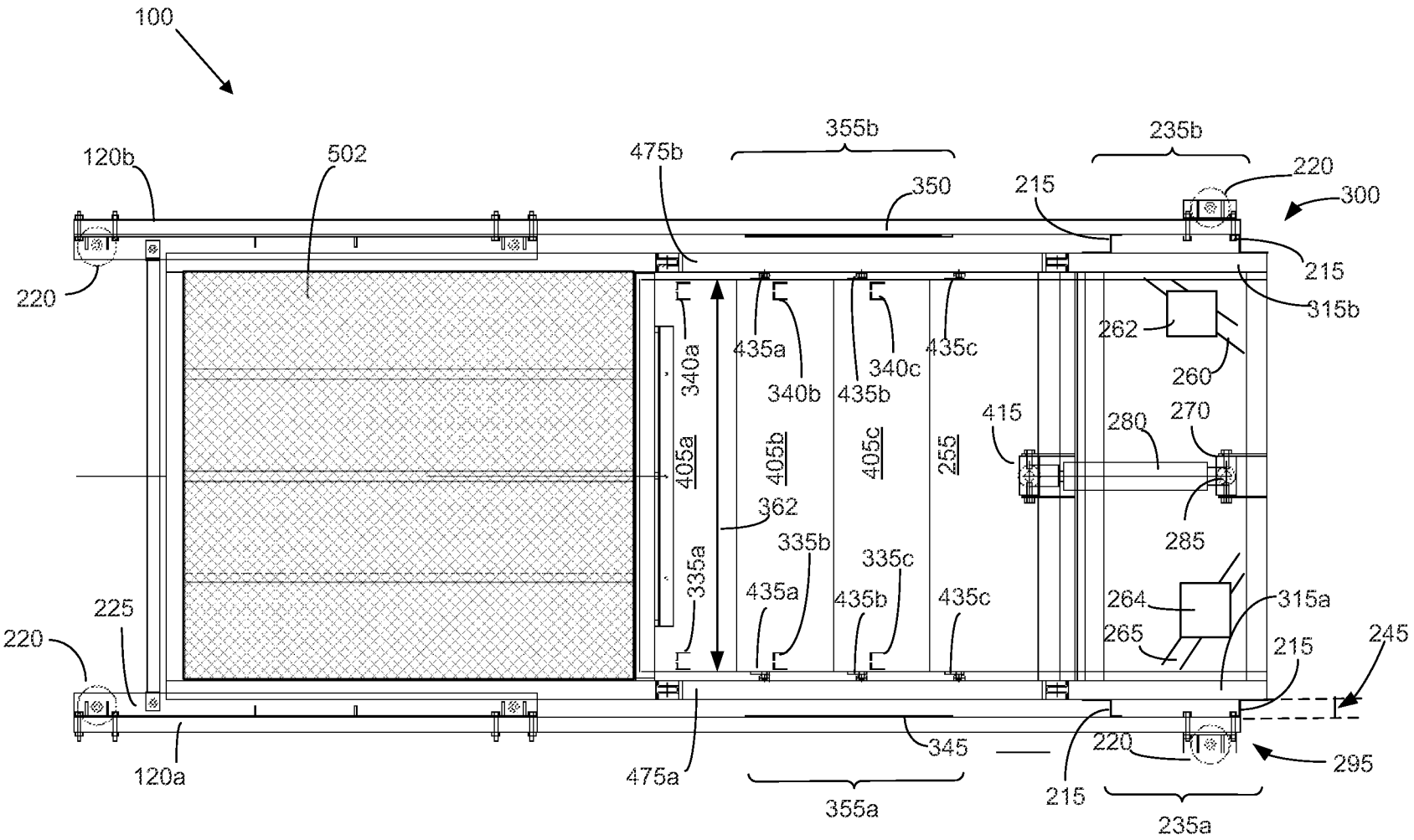
FIG. 4 is top view of the lift apparatus of FIG. 2.

FIGS. 2-4 illustrate the lift apparatus 100 of FIG. 1 in further detail. FIG. 2 is a side view in which platform section 115 is arranged in a first position 200. FIG. 3 is a side view in which platform section 115 is arranged in a second position 205. FIG. 4 is a top view of the example lift apparatus 100 shown in FIG. 2. As described above, the example lift apparatus 100 generally includes landing section 105, linkage section 110, and platform section 115.

In example embodiments, landing section 105 includes side panels 120 and elevated landing 125 that form a stabilization and support structure of the lift apparatus 100. Elevated landing 125 includes landing railing 130. First side panel 120*a* is depicted as transparent in FIGS. 2 and 3 to enable visualization of various example structural features of the lift apparatus 100.

Side panels 120 are similarly configured and form a first portion of the stabilization and support structure of the lift apparatus 100. For example, side panels 120 each include panel mounting brackets 215, adjustable support feet 220, and flange 225. In some embodiments, panel mounting brackets 215 extend along width h3 of each of side panels 120. However, other embodiments are possible. Panel mounting brackets 215 are used to rigidly fasten elevated landing 125 between first panel section 235*a* of first side panel 120*a* and first panel section 235*b* of second side panel 120*b*. Panel mounting brackets 215 are generally sized and configured to provide clearance distance 245 between side panels 120*a-b* and respective portions of landing section 105, linkage section 110, and platform section 115, such as to prevent undesired interactions therebetween.

Adjustable support feet 220 of side panels 120 are constructed to evenly distribute weight of the lift apparatus 100 to support surface 165. In some embodiments, adjustable support feet 220 additionally include height adjustment assembly 250 to aid with leveling and stabilization of the lift apparatus 100 in the event of variations in slope of support surface 165 and adjust elevated landing 255 approximately level to access area 175 of building 180. In some embodiments, flange 225 is configured to receive portions of platform section 115 when the platform section 115 is positioned adjacent to support surface 165, as described further below. Flange 225 additionally provides increased contact surface area between side panels 120 and support surface 165.

In example embodiments, side panels 120 are made of wood, plastic, metal, structural steel tubing, composite materials or combinations of these. Additionally, side panels 120 are customizable with respect to form and style. For example, in some embodiments, side panels 120 may be painted to complement style and architecture of building 180 and surrounding areas. Siding can be installed on exterior surfaces of side panels 120 to match or complement the exterior of a building where the example lift apparatus 100 is installed. In other embodiments, side panels 120 can include additional components, such as a flower box, decorative railings, or other external modifications. Still other embodiments are possible as well.

Referring now to elevated landing 125 of landing section 105. Elevated landing 125 is generally a box structure that forms a second portion of the stabilization and support structure of the example lift apparatus 100. In some embodiments, elevated landing 125 includes extended landing surface 255, first mounting surface 260, second mounting surface 265, first actuator mount 270, and height adjustment guides 275. In example embodiments, extended landing surface 255 and height adjustment guides 275 are generally external to elevated landing 125, while first mounting surface 260, second mounting surface 265, and first actuator mount 270 are generally internal to the elevated landing 125. Extended landing surface 255 is depicted as transparent in FIG. 4 to enable visualization of various example internal structural features of the example elevated landing 125.

In example embodiments, extended landing surface 255 forms a topmost step and landing of lift apparatus 100 and is typically positioned level with respect to access area 175 of building 180. First mounting surface 260 generally forms a mounting structure for electrical control 262 of lift apparatus 100, while second mounting surface 265 generally forms a mounting structure for actuator control 264 of lift apparatus 100, as described further below with respect to FIGS. 14-16. In some embodiments, first actuator mount 270 is rigidly coupled to lower landing portion 268 of elevated landing 125 and generally forms a first mounting structure for actuator 280. In example embodiments, actuator 280 is used to actuate platform section 115 between the first position 200 of FIG. 2 and the second position 205 of FIG. 3. In the example shown, actuator 280 is coupled to first actuator mount 270 at first actuator pivot point 285 such that actuator first end 290 of actuator 280 is enabled to pivot about first actuator pivot point 285.

In example embodiments, height adjustment guides 275 of elevated landing 125 are a series of fastener apertures formed at a pre-defined uniform spacing on first landing lower side 295 and second landing lower side 300 of elevated landing 125. Height adjustment guides 275 are used to accurately position extended landing surface 255 to height h1 of access area 175 of building 180. For example, in certain embodiments, elevated landing 125 is initially raised to a predetermined offset height h2 independent of side panels 120 such that extended landing surface 255 is positioned approximately to height h1 of access area 175. A fastener (e.g., a bolt, weld joint, or any other device that mechanically joins or affixes two or more objects together) is then inserted into a corresponding one of height adjustment guides 275 and tightened such as to make a preliminary connection of side panels 120*a-b* to elevated landing 125 via panel mounting brackets 215. One or more fasteners are subsequently applied at or near fastener sites 310*a-c* to rigidly secure side panels 120 to elevated landing 125. For example, in some embodiments, a hole is initially drilled at or near fastener sites 310*a-c*, followed by insertion and securing of a fastener therein. In this manner, side panels 120 and elevated landing 125 form a stabilization and support structure of lift apparatus 100.

Referring now to landing railing 130 of example landing section 105. Landing railing 130 is generally a structure constructed from rails and upright members used as a guard, barrier and support for a passenger of lift apparatus 100. In some embodiments, landing railing 130 includes landing hand rails 315 and landing side rail section 320. Landing side rail section 320 includes landing side rails 325 and landing side rail supports 330. Landing hand rails 315 and landing side rail supports 330 are generally coupled to respective landing side rails 325, which in turn are generally coupled to elevated landing 125. In example embodiments, landing hand rails 315, landing side rails 325, and landing side rail supports 330 are either circular or non-circular in cross-section and are made of wood, plastic, metal, structural steel tubing, or composite materials. In this manner, respective rails 315, 325 and rail supports 330 of may generally be rigid or flexible as desired and may be coupled to one another and elevated landing 125 via fasteners or welding. Additionally, respective rails 315, 325 and rail supports 330 are customizable with respect to style and construction and are arranged and configured such as to conform to handrail codes and standards where required. Other embodiments of landing railing 130 are possible as well. For example, landing side rail section 320 may include any number of rails as desired.

In some embodiments, landing section 105 additionally includes first step supports 335 and second step supports 340. In general, first step supports 335 are mounted to first side panel 120a and second step supports 340 are mounted to second side panel 120*b* and together form stops to secure steps of stairway 135 when platform section 115 is arranged in the first position 200. In example embodiments, first step supports 335 are integrally formed with first step mounting bracket 345 and second step supports 340 are integrally formed with second step mounting bracket 350. In the example embodiment, first step supports 335 are secured to second panel section 355*a* of first side panel 120*a* by first step mounting bracket 345. Similarly, second step supports 340 are secured to second panel section 355*b* of second side panel 120b by the second step mounting bracket 350.

Other embodiments of first step supports 335 and second step supports 340 are possible as well. For example, in certain embodiments, first step supports 335 may form a single structure with a corresponding step support of second step supports 340. For example, first step support 335*a* and second step support 340*a* may be configured to form a single, integrally formed step support. In the example embodiment, such a single step support would extend the distance 362 within example linkage section 110, as shown in FIG. 4. In a similar manner, first step support 335*b* and second step support 340*b*, as well as first step support 335*c* and second step support 340*c*, respectively, may be arranged to form a respective single, integrally formed step support. Still other embodiments are possible as well.

In some embodiments, first step supports 335 and second step supports 340 are adjustable in height. For example, in one embodiment, each of first step supports 335 and second step supports 340 are constructed from step rest 365 slidably fit within step guide 370. In the example embodiment, height adjustment fasteners 375 securely fasten a respective step rest 365 within corresponding step guide 370 to define a desired height of each of first and second step supports 335, 340 with respect to support surface 165.

In the example shown, first step support 335*a* and second step support 340*a* are adjusted to first step height h4, first step support 335*b* and second step support 340*b* are adjusted to a second step height h5, and first step support 335*c* and second step support 340*c* are adjusted to a third step height h6. In example embodiments, standard step height difference h7 is maintained between consecutive respective step supports such as to conform to codes and standards where required. It will be appreciated that first step supports 335 and second step supports 340 may include more or fewer step supports, such as in a range from about two to about ten, and preferably from about three to about five. In the example shown, range of height adjustment of first step supports 335 and second step supports 340 include a height range from about 27" to about 34" from support surface 165. Other embodiments are possible as well.

Referring now to linkage section 110 of lift apparatus 100. In example embodiments, linkage section 110 generally forms a passageway between landing section 105 and platform section 115 and includes stairway 135 and linkage railing 140. Stairway 135 is generally hingedly coupled to landing section 105 at pivot points B and platform section 115 at pivot points D. Linkage railing 140 is generally hingedly coupled to landing section 105 at pivot points A, pivot points E, and pivot points F, and further generally hingedly coupled to platform section 115 at pivot points C, pivot points G, and pivot points H, as described further below.

Figure 5:
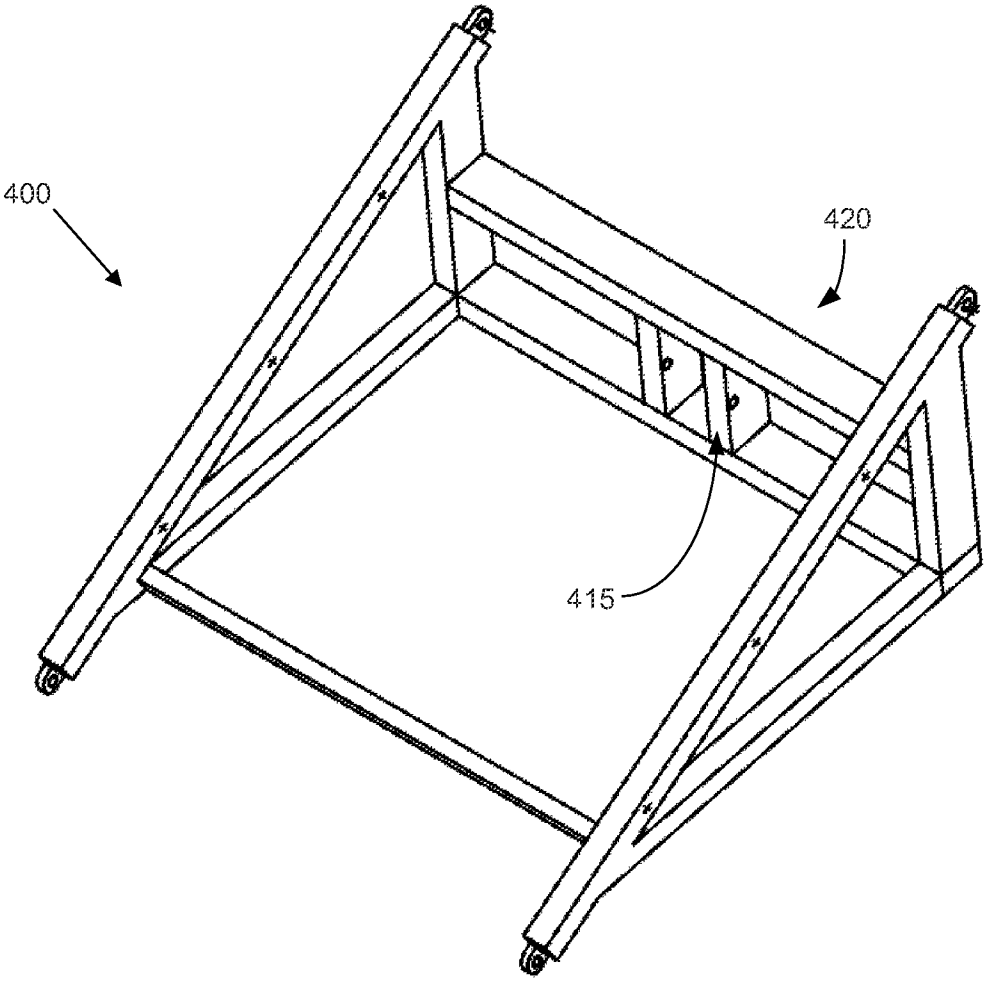
FIG. 5 is a perspective view of an example linkage according to the present disclosure.

Example stairway 135 includes linkage 400, step plates 405, and panels 410. Example linkage 400 includes second actuator mount 415. Referring now additionally to FIG. 5, in which linkage 400 is shown in perspective view, linkage 400 is generally a rigid, wedge-shaped frame formed from wood, plastic, metal, structural steel tubing, or composite materials such as to evenly distribute high loads imparted from actuator 280. Second actuator mount 415 is rigidly coupled to linkage rear portion 420 of linkage 400 and forms a second mounting structure for actuator 280. Actuator 280 is coupled to second actuator mount 415 at second actuator pivot point 425 such that actuator second end 430 of actuator 280 is enabled to pivot about second actuator pivot point 425.

Step plates 405*a-c* are hingedly coupled to linkage 400 at corresponding pivot points 435*a-c*, respectively. Step plates 405 are generally formed from a rigid, durable material such as plastic, metal, structural steel tubing, or composite materials. Panels 410*a-c* are hingedly coupled to respective step plates 405*a-c* at respective panel connection points 440*a-c*, and panel 410*d* is hingedly coupled to extended landing surface 255 at panel connection point 440*d*. In example embodiments, panels 410 are formed from a durable, textured flexible rubber material, such as for example, high density polyethylene, and are connected to respective step plates 405 and extended landing surface 255 along distance 362 as shown in FIG. 4.

In example embodiments, linkage 400 is arranged as stairway frame 445 and step plates 405 are arranged as stairway steps 450, together with the extended landing surface 255, when platform section 115 is in the first position 200. In the first position 200, step plates 405 are in contact with and supported by corresponding first step supports 335 and second step supports 340. For example, step plate 405*a* is in contact with both first step support 335*a* and second step support 340*a*. Similarly, step plate 405*b* is in contact with both first step support 335*b* and second step support 340*b*, and step plate 405*c* is in contact with both first step support 335*c* and second step support 340*c*. Further, panels 410*a-d* are positioned at rest against respective panel stops 455*a-d* such as to obscure internal structural features of lift apparatus 100.

Linkage 400 is arranged as horizontal surface frame 460 and step plates 405 are arranged as horizontal surface 465, together with the extended landing surface 255, when platform section 115 is in the second position 205. In the second position 205, step plates 405 are in contact with and supported by tab rest surface 470 integrally formed with each of step plates 405. For example, while referring to FIG. 3, step plate 405*b* is in contact with tab rest surface 470*a* of step plate 405*a*. Similarly, step plate 405*c* is in contact with tab rest surface 470*b* of step plate 405*b*, and extended landing surface 255 is in contact with tab rest surface 470*c* of step plate 405*c*. Step plate 405*a* is in contact with linkage tab rest surface 472 of linkage 400. In this manner, step plates 405 are generally positioned within linkage 400 and held in place by force of gravity. Further, panels 410 hang freely below linkage 400 by force of gravity.

Referring now to linkage railing 140 of linkage section 110. In general, example linkage railing 140 is a structure constructed from rails and upright members used as a guard, barrier or support for a passenger of the example lift apparatus 100. In example embodiments, linkage railing 140 includes linkage hand rails 475 and linkage side rail section 480. Linkage side rail section 480 includes linkage side rails 485 and linkage side rail supports 490. Linkage hand rails 475 are hingedly coupled to landing section 105 at pivot points A and to platform section 115 at pivot points C. Linkage side rail supports 490 are hingedly coupled to landing section 105 at pivot points E and pivot points F and platform section 115 at pivot points G and pivot points H. Linkage side rails 485 are rigidly coupled between linkage side rail supports 490.

In example embodiments, linkage hand rails 475, linkage side rails 485, and linkage side rail supports 490 are either circular or non-circular in cross-section and are made of wood, plastic, metal, structural steel tubing, or composite materials. In this manner, respective rails 475, 485, and rail supports 490 may generally be rigid or flexible as desired and may be coupled to one another via fasteners or welding. For example, in some embodiments, respective rails of linkage side rail section 480 are made from a flexible material such as to flex and pivot with movement of platform section 115 between the first position 200 and the second position 205. In this manner, linkage side rail section 480 simultaneously provides protection as guard, barrier or support. Additionally, respective rails 475, 485, and rail supports 490 are customizable with respect to style and construction and are arranged and configured such as to conform to handrail codes and standards where required. Other embodiments of the linkage railing 140 are possible as well. For example, landing side rail section 480 may include any number of rails as desired.

Referring now to platform section 115 of the example lift apparatus 100. In general, platform section 115 includes passenger platform 145, ramp 150, gate 155, and platform railing 160. In example embodiments, platform section 115 is arranged in the first position 200 when actuator 280 is in a first configuration 495. In the first position 200, gate 155 in generally in an open position, as described further below, and passenger platform 145 is positioned adjacent to the support surface 165 in contact with flange 225 of each of side panels 120. Further, step plates 405 are in contact with and supported by corresponding first step supports 335 and second step supports 340, as described above. Platform section 115 is arranged in the second position 205 when actuator 280 is in a second configuration 500. In the second position 205, gate 155 is generally in a closed position, as described further below, and passenger platform 145 is positioned level with respect access area 175 of building 180. Further, step plates 405 are in contact with and supported by respective tab rest surface 470 and linkage tab rest surface 472.

In some embodiments, passenger platform 145 is formed from expanded metal 502 such that a passenger may see through passenger platform 145 to the portion of support surface 165 immediately beneath passenger platform 145 to identify potential obstructions. However, other embodiments are possible as well. For example, passenger platform 145 may be formed from sheet metal. In some embodiments, ramp 150 is formed as a separate structure from platform section 115. In the example embodiment, ramp 150 remains adjacent to support surface 165 as platform section 115 is actuated between the first position 200 and the second position 205. However, other embodiments are possible as well. For example, in certain embodiments, ramp 150 is hingedly coupled to passenger platform 145 and configured to be actuated between a deployed position when platform section 115 is arranged the first position 200 and a retracted position arranged adjacent to platform railing 160 when platform section 115 is not arranged the first position 200.

Referring now to platform railing 160 of platform section 115. In general, platform railing 160 is a structure constructed from rails and upright members used as a guard, barrier or support for a passenger of lift apparatus 100. In example embodiments, platform railing 160 includes platform hand rails 505 and platform side rail section 507. Platform side rail section 507 includes platform side rails 510 and platform side rail supports 515. As described above, platform hand rails 505 are hingedly coupled to linkage section 110 at pivot points C. Additionally, platform side rail supports 515 are generally hingedly coupled to linkage section 110 at pivot points G and pivot points H. Platform side rails 510 are rigidly coupled between platform side rail supports 515.

In example embodiments, platform hand rails 505, platform side rails 510, and platform side rail supports 515 are either circular or non-circular in cross-section and are made of wood, plastic, metal, structural steel tubing, or composite materials. In this manner, respective rails 505, 510, and rail supports 515 may generally be rigid or flexible as desired and may be coupled to one another via fasteners or welding. Additionally, respective rails 505, 510, and rail supports 515 are customizable with respect to style and construction and are arranged and configured such as to conform to handrail codes and standards where required. Other embodiments of the platform railing 160 are possible as well. For example, platform side rail section 507 may include any number of rails as desired.

Figure 6:
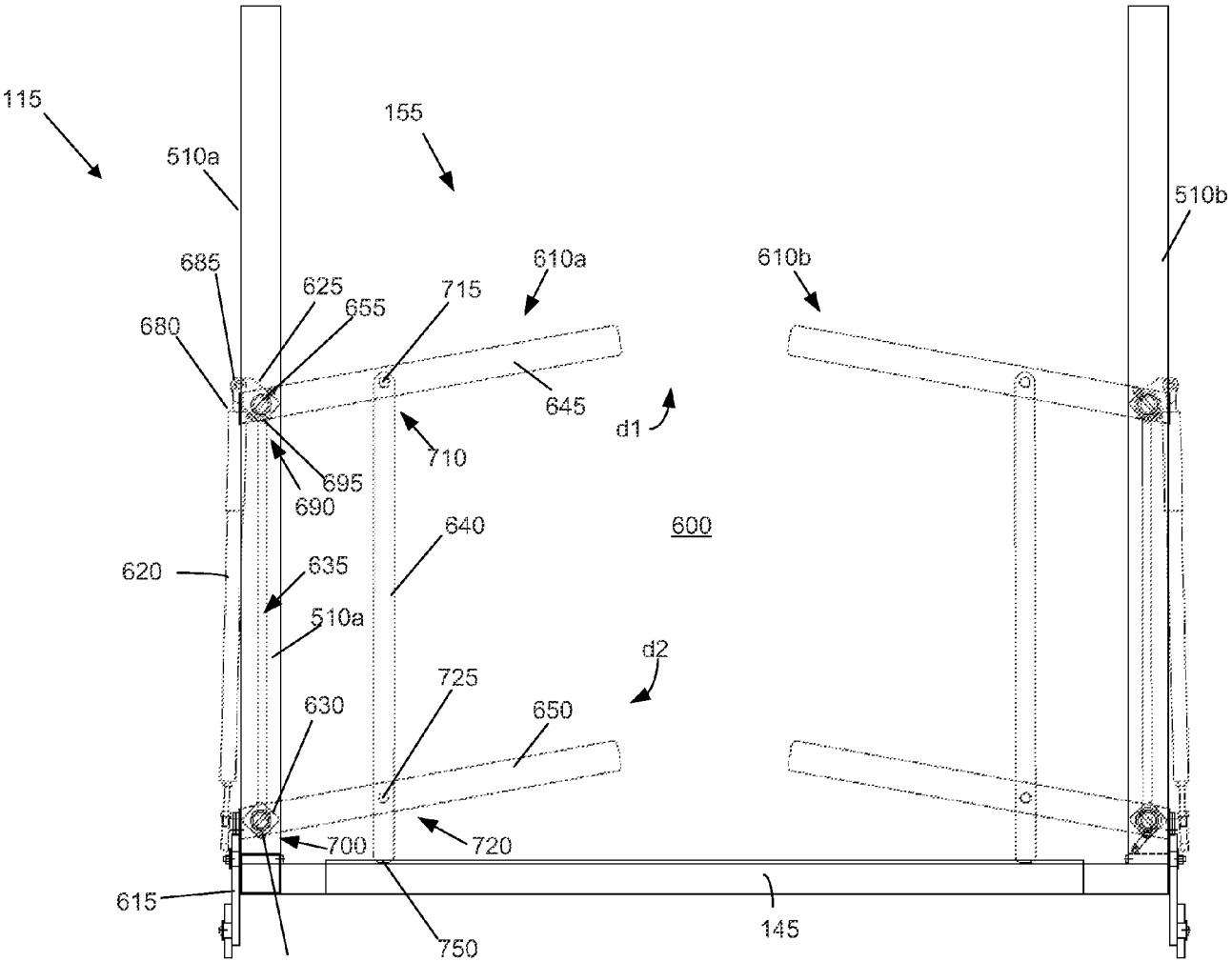
FIG. 6 is a front view of an example platform section according to the present disclosure in which an example gate is arranged in a closed position.
Figure 7:
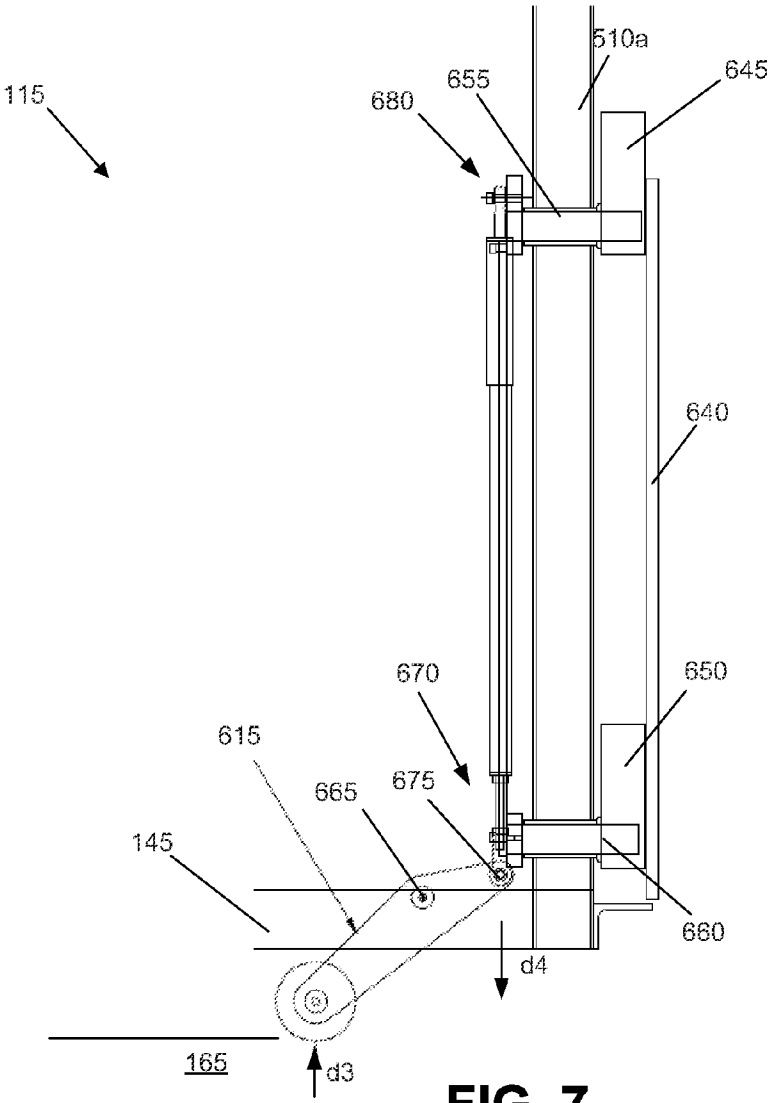
FIG. 7 is a side view of the platform section of FIG. 6.
Figure 8:
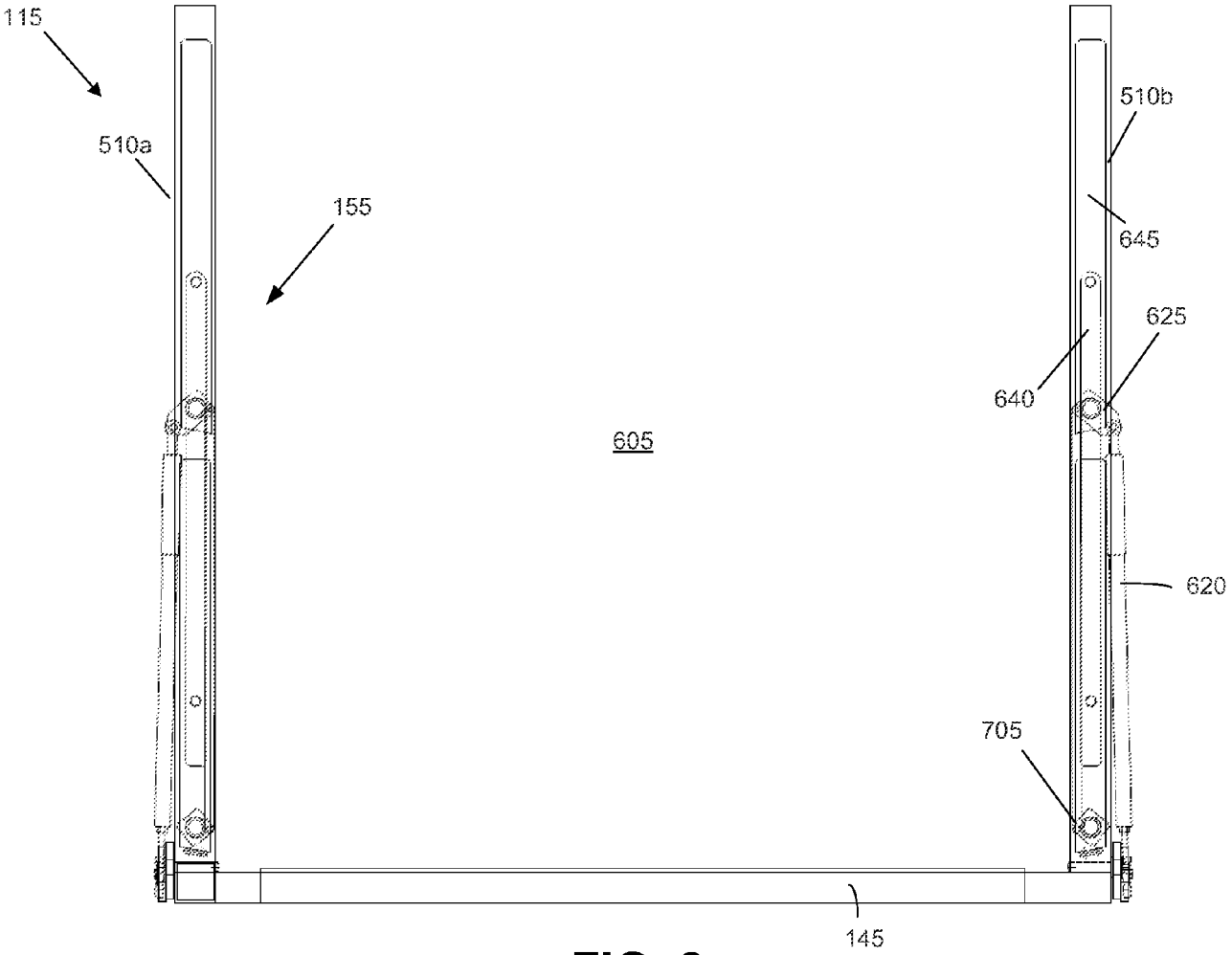
FIG. 8 is a front view of the platform section of FIG. 6 in which the example gate is arranged in a closed position.
Figure 9:
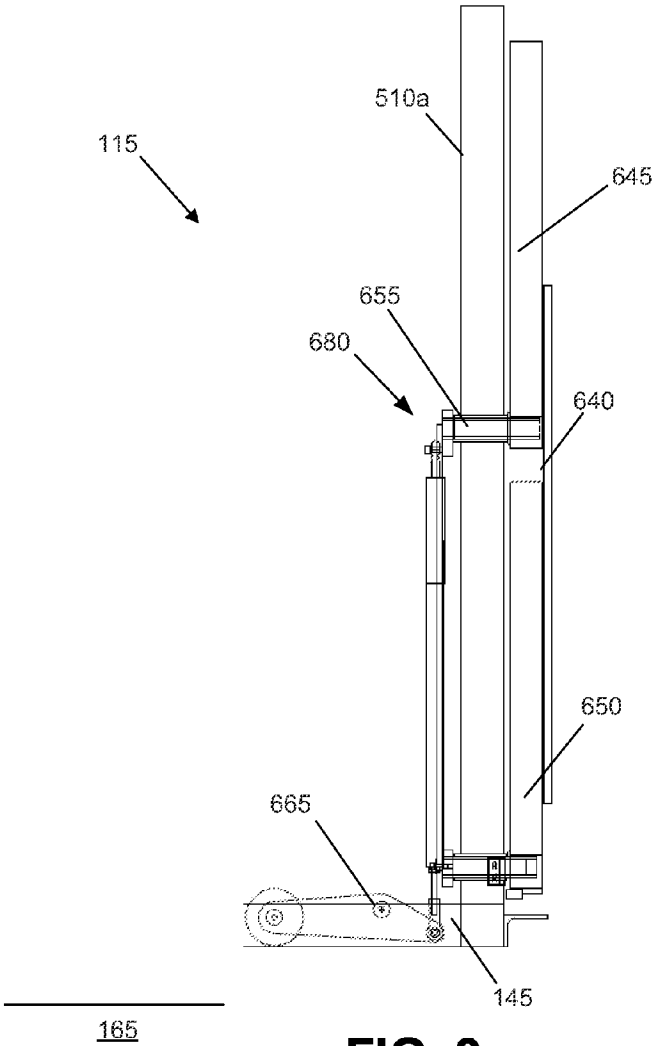
FIG. 9 is a side view of the platform section of FIG. 8.

FIGS. 6-9 show platform section 115 of FIGS. 1-4 in further detail. FIG. 6 is a front view of platform section 115 in which gate 155 is arranged in a closed position 600. FIG. 7 is a side view of FIG. 6. FIG. 8 is a front view of platform section 115 in which gate 155 arranged in an open position 605. FIG. 9 is a side view of FIG. 8. In general, gate 155 includes a passive actuation mechanism that positions gate 155 to the open position 605 when platform section 115 is in the first position 200, as described above. Otherwise, the passive actuation mechanism positions gate 155 to the closed position 600.

Example gate 155 generally includes arm assembly 610*a-b*. Arm assembly 610*a* and 610*b* are similarly configured and each include lever arm 615, spring loaded link 620, pivot lever 625, pivot flange 630, first linkage member 635, second linkage member 640, first gate arm 645, second gate arm 650, first pin 655, and second pin 660. In example embodiments, lever arm 615 is pivotally connected to passenger platform 145 at first pivot point 665. Spring link first end 670 of spring loaded link 620 is pivotally connected to lever arm 615 at second pivot point 675. Spring link second end 680 of spring loaded link 620 is pivotally connected to pivot lever 625 at third pivot point 685. First end 690 of first linkage member 635 is pivotally connected to pivot lever 625 at fourth pivot point 695. Pivot lever 625 is connected to first pin 655. Second end 700 of first linkage member 635 is pivotally connected to pivot flange 630 at fifth pivot point 705. First gate arm 645 is connected to pivot lever 625 via first pin 655 through respective platform side rail 510*a-b*. Second gate arm 650 is connected to pivot flange 630 via second pin 660 through respective platform side rail 510*a-b*. First end 710 of second linkage member 640 is pivotally connected to first gate arm 645 at sixth pivot point 715. Second end 720 of second linkage member 640 is pivotally connected to second gate arm 650 at seventh pivot point 725.

In example embodiments, when platform section 115 is in the first position 200 as described above, interaction of lever arm 615 with support surface 165 or on flange 225 imparts force on lever arm 615 in direction d3 such that spring link first end 670 of spring loaded link 620 pulls pivot lever 625 in direction d4. As pivot lever 625 is connected to first gate arm 645 via first pin 655, first gate arm 645 is actuated in direction d1. Second gate arm 650 is also actuated in direction 740 via first linkage member 635 and second linkage member 640 that connects first gate arm 645 to second gate arm 650 in a four-bar linkage configuration. In example embodiments, undesired resistance on arm 645 and 650 imparts a load on the internal spring of link 620 such that motion of first gate arm 645 and second gate arm 650 ceases when obstructed.

As platform section 115 is actuated from the first position 200 to the second position 205, an external spring (not shown) imparts force on lever arm 615 in direction d4 such that pivot lever 625 is pulled in the direction opposite direction d4. The force imparted on lever arm 615 in direction d3, along with force of gravity imparted on first gate 645 and second gate arm 650, actuates first gate arm 645 and second gate arm 650 in direction d2 until stop end 750 of second linkage member 640 interacts with passenger platform 145.

In example embodiments, respective components of arm assembly 610 are made of wood, plastic, metal, structural steel tubing, or composite materials and as such may generally be rigid or flexible as desired and may be coupled to one another via fasteners or welding. Additionally, respective components of arm assembly 610 are customizable with respect to style and construction and are arranged configured such as to conform to handrail codes and standards where required.

Figure 10:
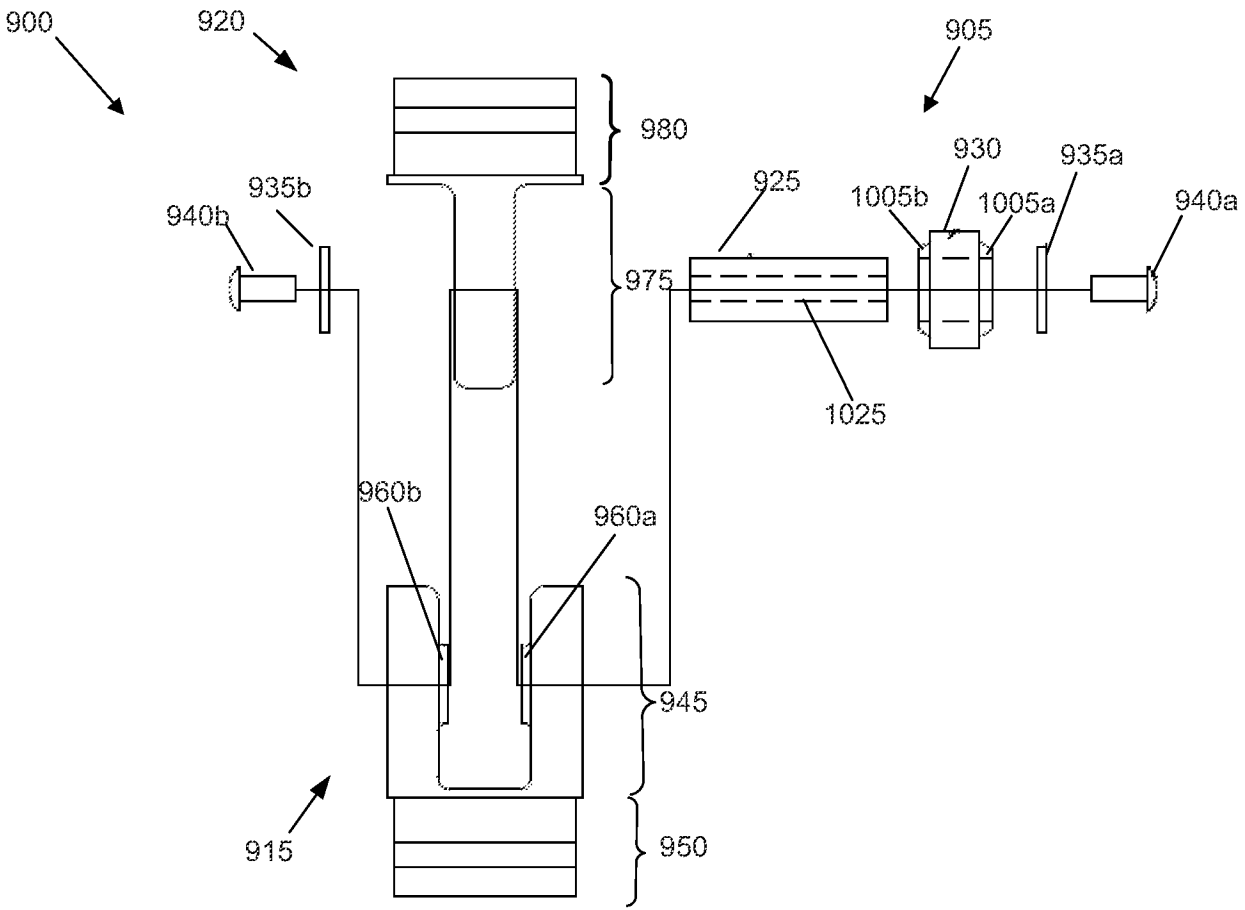
FIG. 10 is a front view of an example bushing assembly according to the present disclosure in which the example bushing is in a disassembled configuration.
Figure 11:
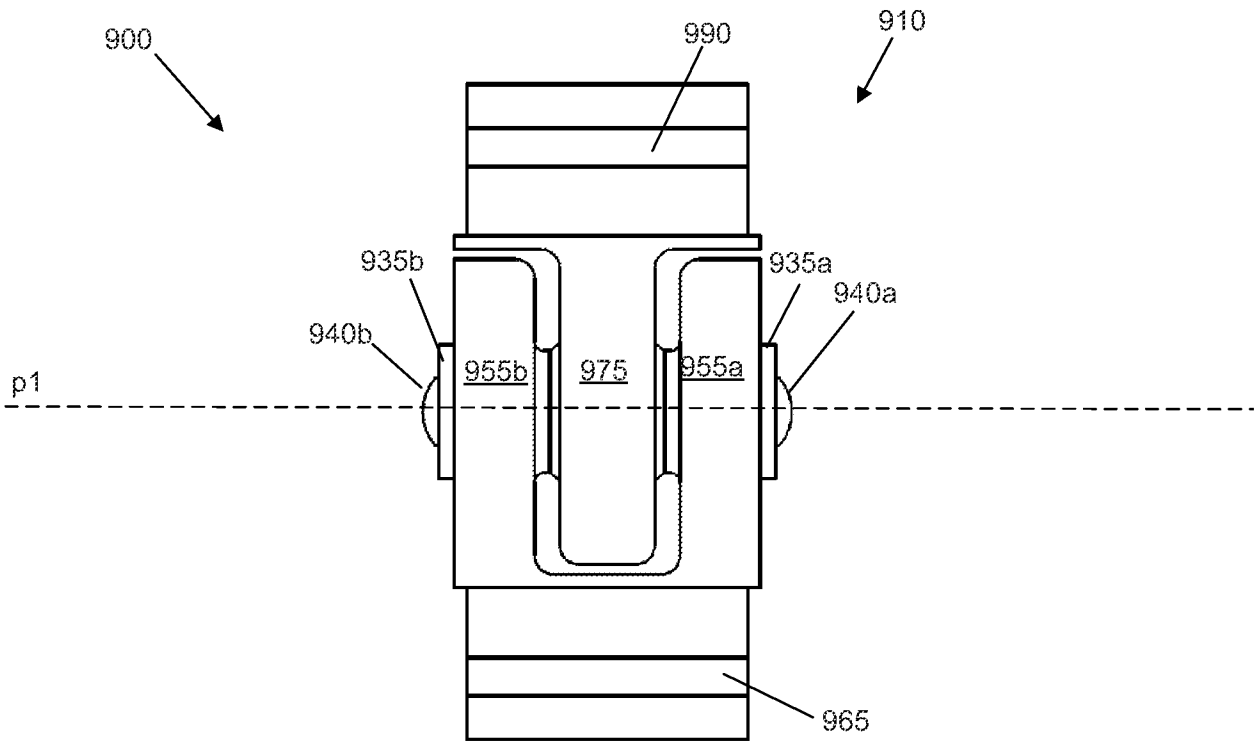
FIG. 11 is a front view of the bushing assembly of FIG. 10 in which the example bushing assembly is in an assembled configuration.
Figure 12:
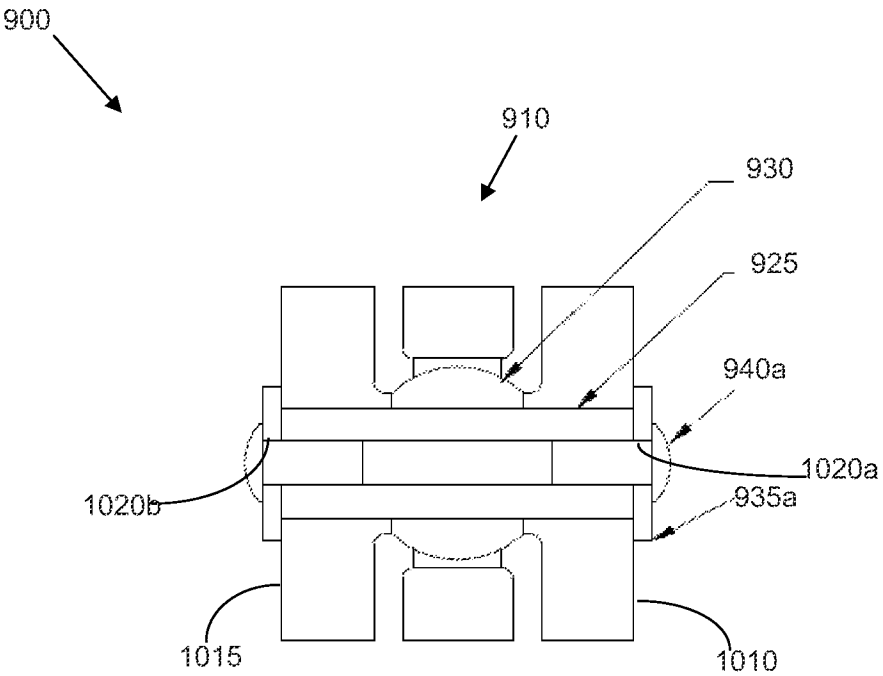
FIG. 12 is cross-sectional view of the bushing of FIG. 11.
Figure 13:
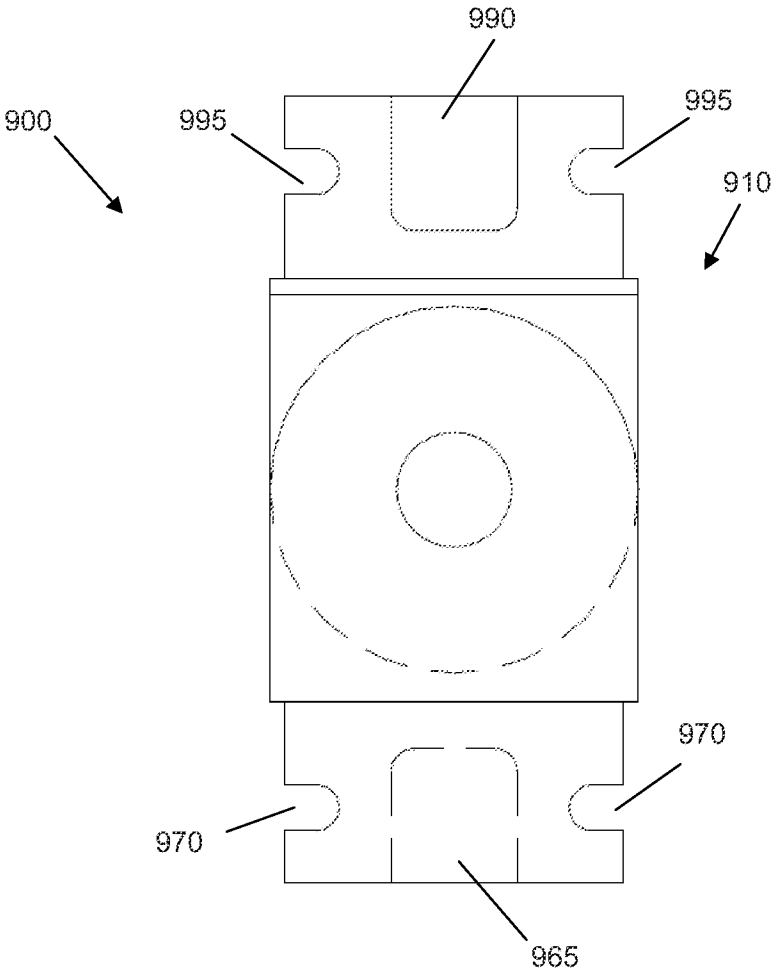
FIG. 13 is a side view of the bushing of FIG. 11.

Referring now to FIGS. 10-13, example bushing assembly 900 is shown. FIG. 10 is a front view of bushing assembly 900 in a disassembled configuration 905. FIG. 11 is a front view of bushing assembly 900 of FIG. 10 in an assembled configuration 910. FIG. 12 is a cross-sectional view of bushing assembly 900 of FIG. 10 in the assembled configuration 910. FIG. 13 is a side view of bushing assembly 900 of FIG. 10. In general, bushing assembly 900 may be incorporated within one or more of pivot points A-D as described above with respect to FIGS. 1-4.

In example embodiments, bushing assembly 900 includes yoke 915, rod 920, shaft 925, spherical bearing 930, flat washers 935, and cap screws 940. Yoke 915 includes cavity section 945 and yoke fastening section 950. Cavity section 945 includes posts 955 and cavity flanges 960. Yoke fastening section 950 includes first yoke fastening receptacle 965 and second yoke fastening receptacle 970. Rod 920 includes body member 975 and body fastening section 980. Body fastening section 980 includes first rod fastening receptacle 990 and second rod fastening receptacle 995. Spherical bearing 930 includes spherical bearing flanges 1005.

In the assembled configuration 910, spherical bearing 930 is positioned within body member 975. Body member 975 is positioned between posts 955*a-b* of cavity section 945 such that respective spherical bearing flanges 1005*a-b* are positioned adjacent and in contact with respective cavity flanges 960*a-b*. Shaft 925 is positioned through spherical bearing 930. Flat washer 935*a* is positioned to first end 1010 of yoke 915, and flat washer 935*b* is positioned to second end 1015 of yoke 915. Cap screws 940*a-b* are positioned through respective flat washer apertures 1020*a-b* and screwed into shaft 925 via internal thread 1025 of shaft 925. In this manner, yoke 915 and rod 920 are enabled to pivot with respect to each about pivot axis p1.

In example embodiments, bushing assembly 900 is positioned at one or more of pivot points A-D of lift apparatus 100. For example, referring now additionally to FIG. 2, bushing assembly 900 is shown at least incorporated within pivot point A. In the example embodiment, landing hand rail 315*a* and linkage hand rail 475*a* are hingedly connected via bushing assembly 900 incorporated within pivot point A.

In the example shown, landing hand rail 315*a* includes landing hand rail fastening member 1030 and landing hand rail apertures 1040. Linkage hand rail 475*a* includes linkage hand rail fastening member 1045 and linkage hand rail apertures 1050. In one example, landing hand rail fastening member 1030 is positioned to first yoke fastening receptacle 965 and a fastener is positioned and secured within landing hand rail apertures 1040 through second yoke fastening receptacle 970 to lock yoke 915 in place to landing hand rail 315*a*. Similarly, linkage hand rail fastening member 1045 is positioned to first rod fastening receptacle 990 and a fastener is positioned and secured within linkage hand rail apertures 1050 through second rod fastening receptacle 995 to lock rod 920 in place to linkage hand rail 475*a*. In this manner, bushing assembly 900 is positioned at one or more of pivot points A-D of example lift apparatus 100.

In example embodiments, respective components of bushing assembly 900 are made from rugged, weather resistant materials such as high strength carbon reinforced engineering plastic high plastic, metal, or other composite materials.

Figure 14:
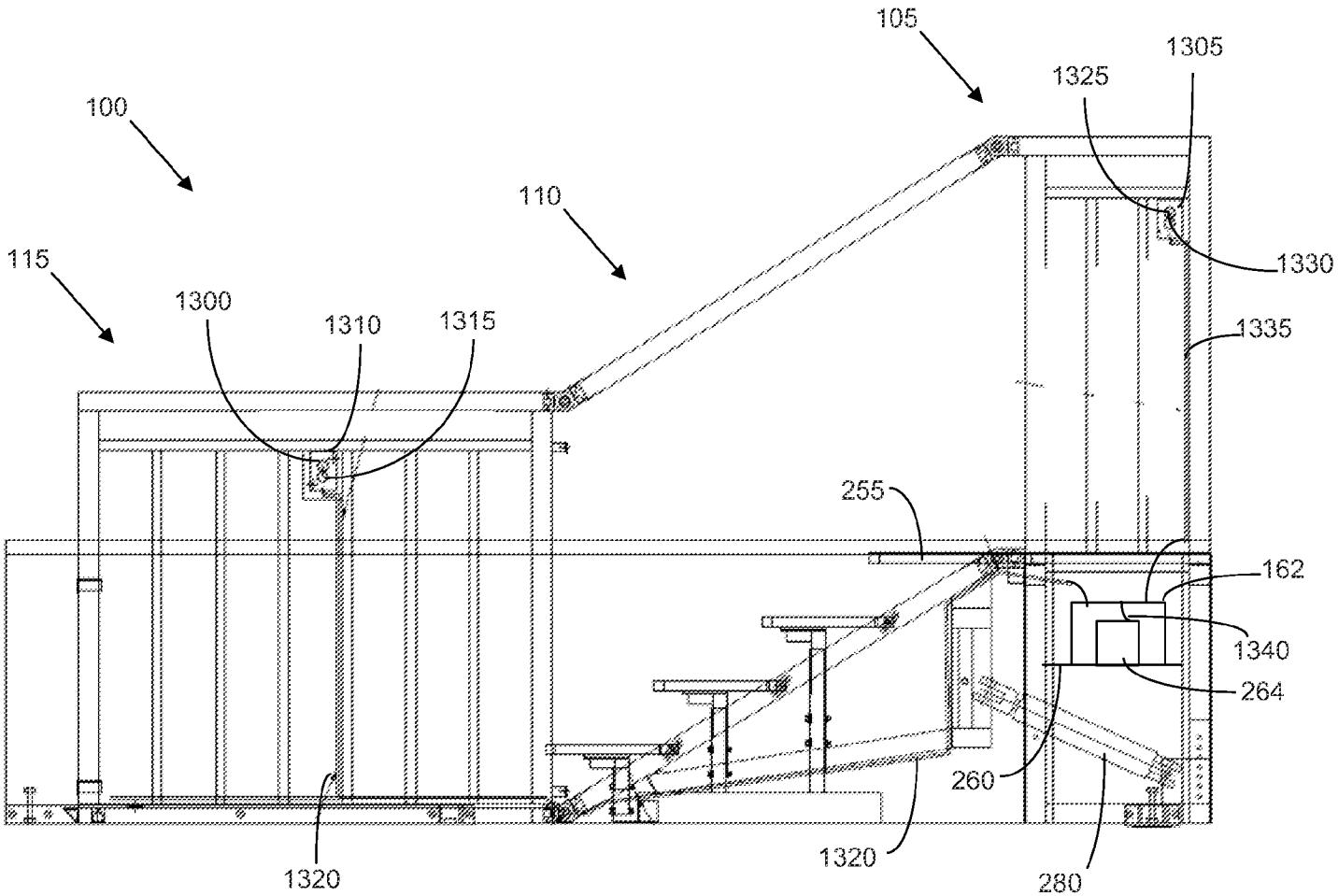
FIG. 14 a side view of the lift apparatus of FIG. 1 including an electrical control and an actuator control according to the present disclosure.
Figure 15:
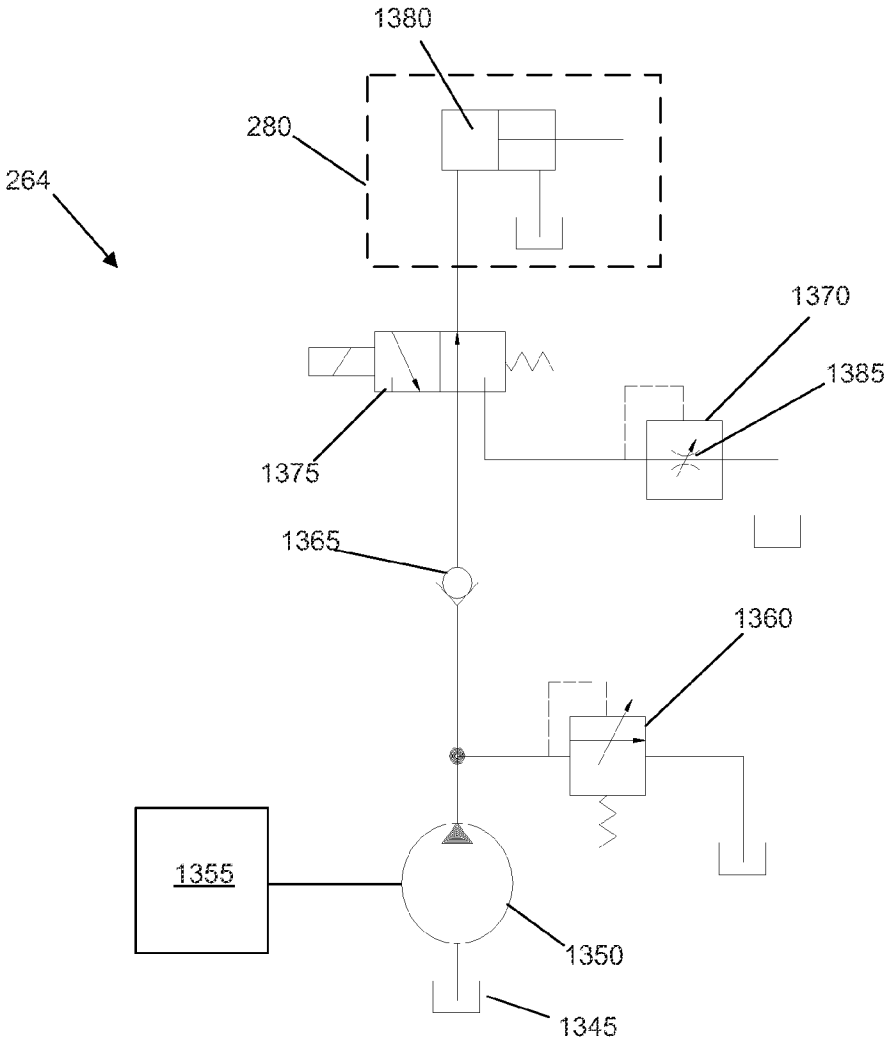
FIG. 15 shows a schematic view of the actuator control of FIG. 14.
Figure 16:
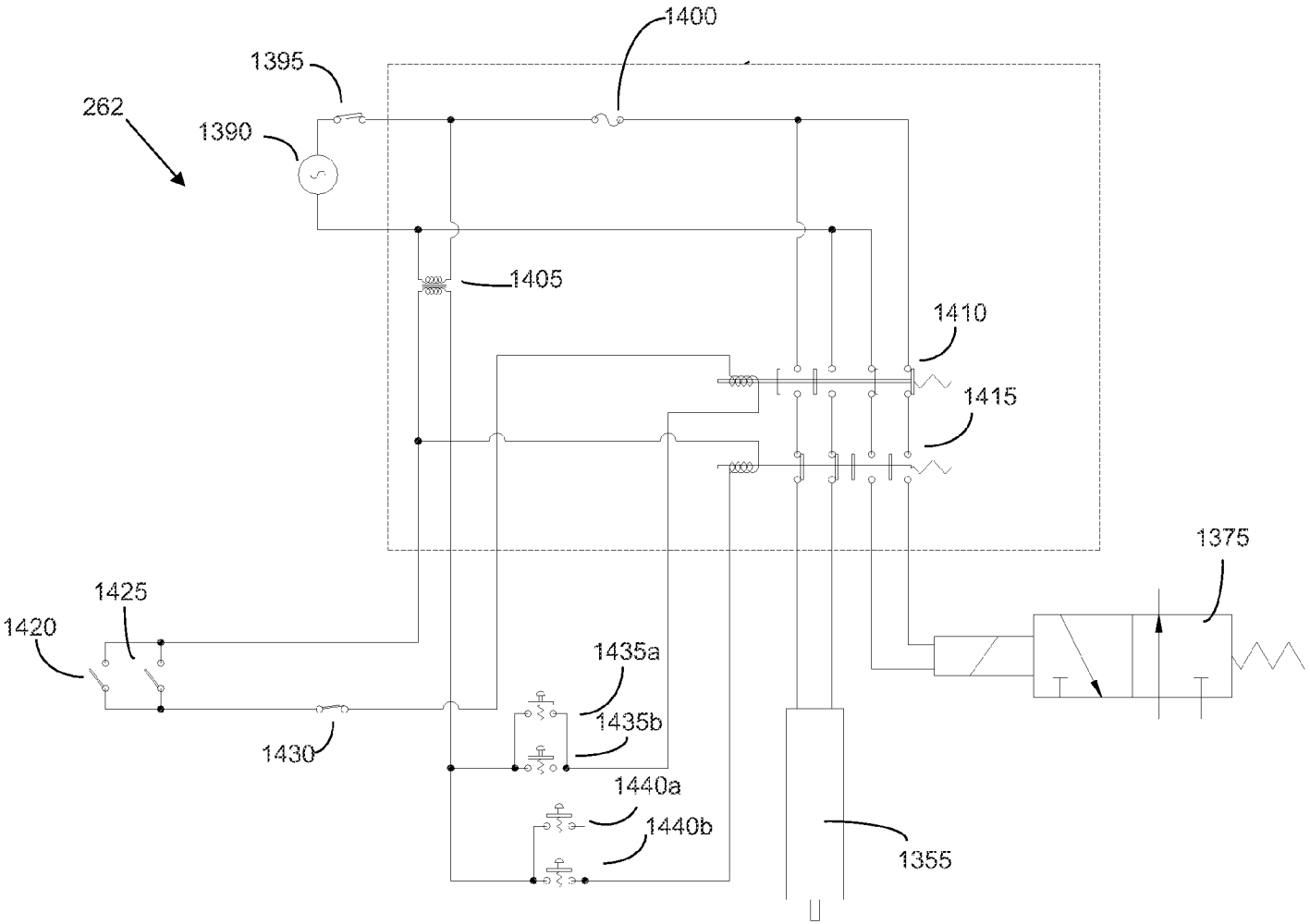
FIG. 16 shows a schematic view of the electrical control of FIG. 14.

FIGS. 14-16 illustrate electrical control 262 and actuator control 264 of lift apparatus 100 in further detail. FIG. 14 is a side view of lift apparatus 100 of FIG. 1 including electrical control 262 and actuator control 264. FIG. 15 is a schematic view of actuator control 264. FIG. 16 is a schematic view of electrical control 262.

In some embodiments, electrical control 262 is mounted to first mounting surface 260 of elevated landing 125 and actuator control 264 is mounted to second mounting surface 265 of elevated landing 125. In example embodiments, electrical control 262 generally includes and is electrically connected to first switch 1300 and second switch 1305. Electrical control 262 is additionally electrically connected to actuator control 264. In the example shown, first switch 1300 includes first up-switch 1310 and first down-switch 1315 and is positioned at platform section 115 with electrical connection made to electrical control 262 via first conduit 1320. In example embodiments, first conduit 1320 is generally threaded from electrical control 262 to first switch 1300 through portions of landing section 105, linkage section 110, and platform section 115. However, other embodiments are possible as well.

Second switch 1305 includes second up-switch 1325 and second down-switch 1330 and is positioned at landing section 105 with electrical connection made to electrical control 262 via second conduit 1335. In example embodiments, second conduit 1335 is generally threaded from electrical control 262 to second switch 1305. However, other embodiments are possible as well. Electrical control 262 is electrically connected to actuator control 264 via third conduit 1340. In example embodiments, electrical conductors (not shown) are positioned within first conduit 1320, second conduit 1335, and third conduit 1340 such that electrical control signals are transferred between electrical control 262 and first switch 1300, second switch 1305, and actuator control 264, respectively.

Referring now to FIG. 15, in some embodiments, actuator control 264 includes a self contained hydraulic power unit that controls actuator 280. For example, in some embodiments, actuator control 264 includes fluid supply 1345, pump 1350, motor 1355, adjustable relief valve 1360, check valve 1365, adjustable flow control 1370, and solenoid valve 1375. Solenoid valve 1375 is coupled to cylinder 1380 of actuator 280. In general, power to lift passenger platform 145 to the second position 205 as described above is provided by cylinder 1380 of actuator 280 as supplied with pressurized fluid from actuator control 264. Lowering of passenger platform 145 to first position 200 is accomplished by bleeding pressurized fluid from cylinder 1380 via adjustable flow control 1370. In some embodiments, adjustable flow control 1370 includes pressure compensated orifice 1385 to control rate of pressurized fluid flow. In this manner, passenger platform 145 may be lowered at a constant rate regardless of load. Additionally, in the example embodiment, passenger platform 145 may be lowered upon failure of either pump 1350 or motor 1355 as adjustable flow control 1370 is operatively independent of pump 1350 and motor 1355.

Other embodiments of actuator control 264 are possible as well. For example, actuator control 264 may include other power sources and drive units, such as an electric, gas, or pneumatic unit. Other embodiments of a drive unit includes a winch style mechanism. Other embodiments of actuator control 264 may include a storage battery to supply power to actuator control 264 in case of a general power failure, or a hydraulic hand pump as a back-up to the primary pump so lift apparatus 100 may be operated manually in event of emergency. Still other embodiments are possible as well.

Referring now to FIG. 16, in some embodiments, electrical control 262 includes power supply 1390, on-switch 1395, fuse 1400, transformer 1405, first relay 1410, second relay 1415, first normally open switch 1420, second normally open switch 1425, first normally closed switch 1430, raise buttons 1435 (e.g., corresponding to first up-switch 1310, second up-switch 1325), and lower buttons 1440 (e.g., corresponding to first down-switch 1315, second down-switch 1330). In the example shown, electrical control 262 is connected to motor 1355 and solenoid valve 1375 of actuator control 264. Other embodiments of electrical control 262 are possible as well.

In example embodiments, motor 1355 drives pump 1350 which supplies fluid to cylinder 1380 of actuator 280. Fluid is drained from cylinder 1380 via solenoid valve 1375 which directs the fluid to adjustable flow control 1370. Motor 1355 and solenoid valve 1375 are controlled via electrical control 262 using a 12 VDC circuit that runs first relay 1410 and second relay 1415 which provides power from power supply 1390 to either motor 1355 or solenoid valve 1375. In some embodiments, power supply 1390 is a 120VAC supply. Other embodiments are possible as well.

For example, engaging one of raise buttons 1435*a-b* completes the 12VDC circuit to first relay 1410 such that power from power supply 1390 is supplied to motor 1355. Subsequently, motor 1355 drives pump 1350 which supplies pressurized fluid to cylinder 1380, thereby causing cylinder 1380 to extend (e.g., actuator 280 is positioned to second configuration 500, as described above). When the one of raise buttons 1435*a-b* is disengaged, the 12VDC circuit to first relay 1410 is broken. Power from power supply 1390 to motor 1355 is interrupted and pump 1350 is disabled. In example embodiments, pressurized fluid is subsequently held cylinder 1380 via check valve 1365.

In example embodiments, engaging one of lower buttons 1440*a-b* completes the 12VDC circuit to second relay 1415 such that power from power supply 1390 is supplied to solenoid valve 1375. Subsequently, solenoid valve 1375 directs pressurized fluid from cylinder 1380 through pressure compensated orifice 1385 of adjustable flow control 1370. In example embodiments, pressure compensated orifice 1385 is configured to maintain a fixed rate of pressurized fluid flow from cylinder 1380. In this manner, cylinder 1380 retracts at a controlled rate regardless of load on cylinder 1380. When the one of lower buttons 1440 is disengaged, the 12VDC circuit to second relay 1415 is broken. Power from power supply 1390 to solenoid valve 1375 is interrupted such that solenoid valve 1375 closes and release of pressurized fluid from cylinder 1380 is terminated. Upon termination of release of pressurized fluid from cylinder 1380, cylinder 1380 stops retracting. In some embodiments, upon engaging one of raise buttons 1435*a-b* and one of lower buttons 1440*a-b* simultaneously, neither 12VDC circuit to first relay 1410 nor second relay 1415 is completed.

Figure 17:
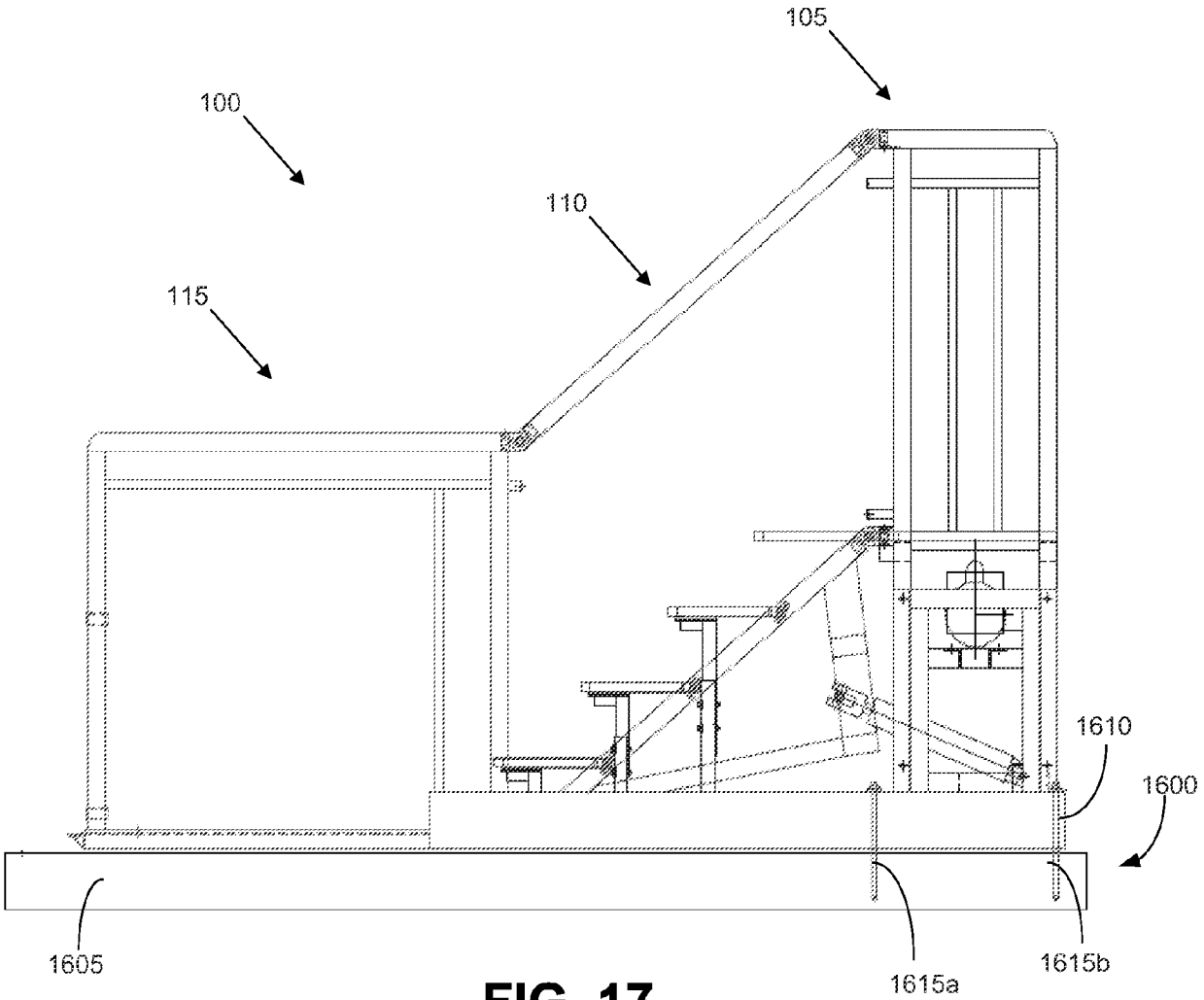
FIG. 17 is a side view of the lift apparatus of FIG. 1 mounted to a first example structure.
Figure 18:
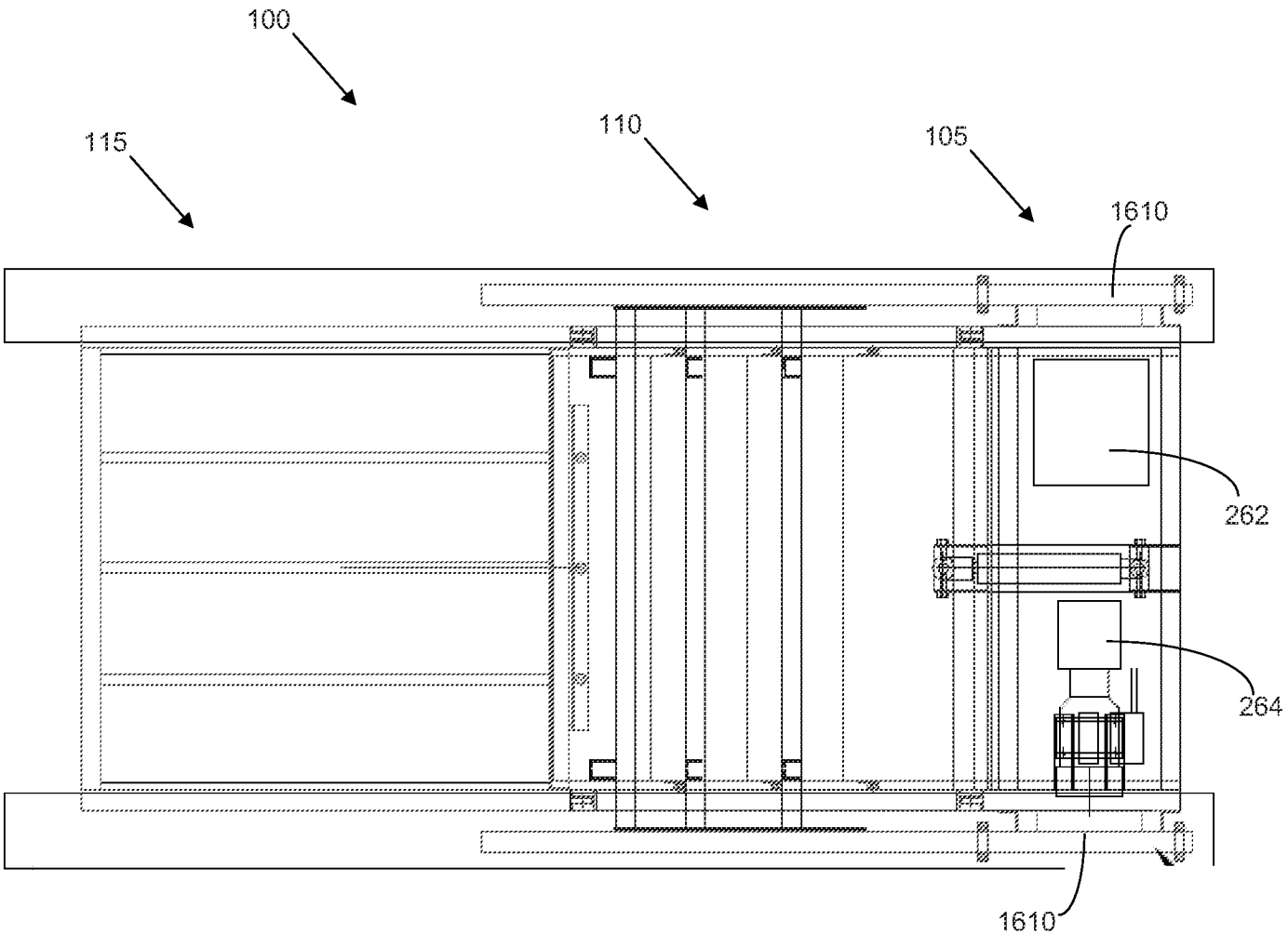
FIG. 18 is a top view of the lift apparatus of FIG. 17.
Figure 19:
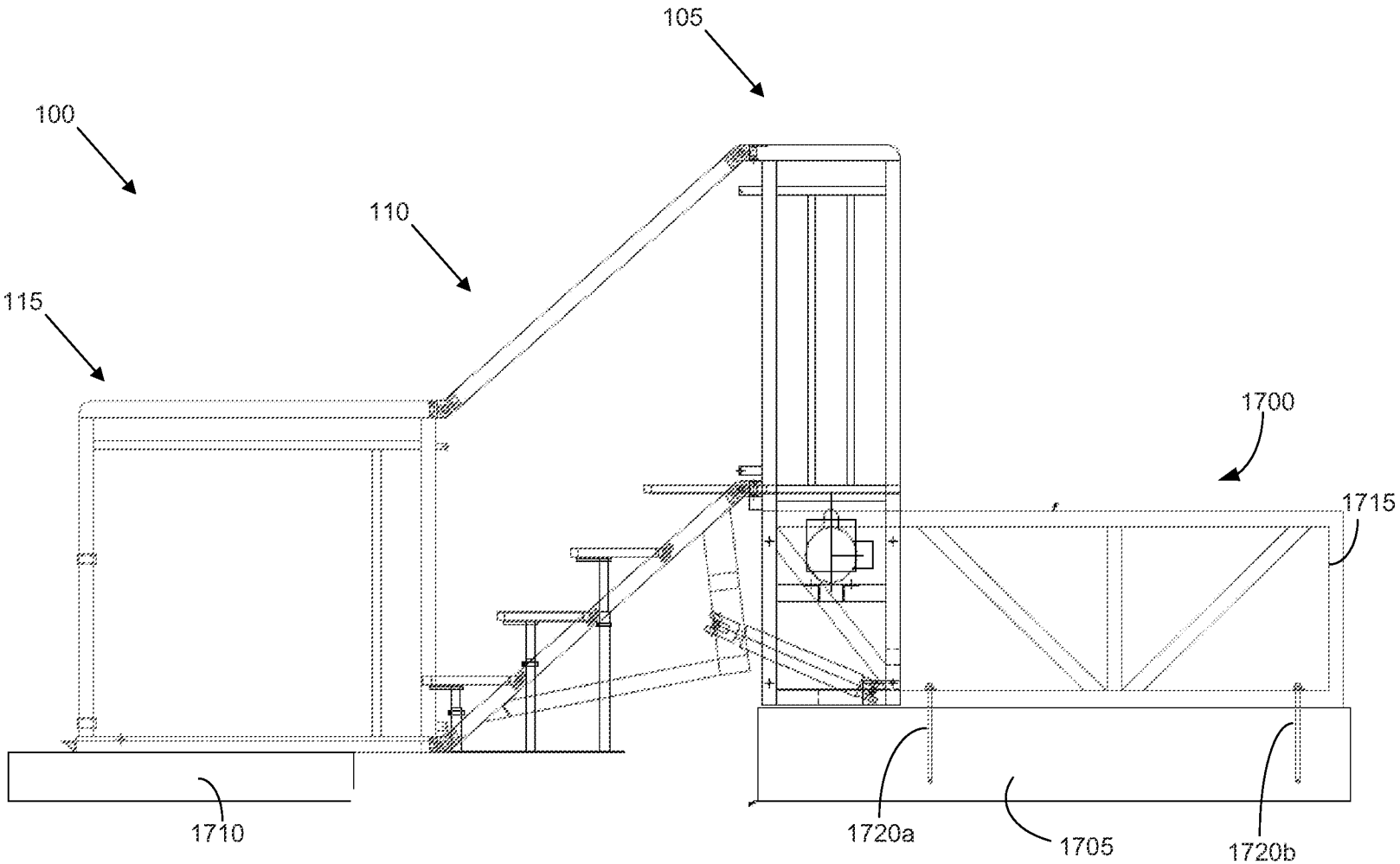
FIG. 19 is a side view of lift apparatus of FIG. 1 mounted to a second example structure.
Figure 20:
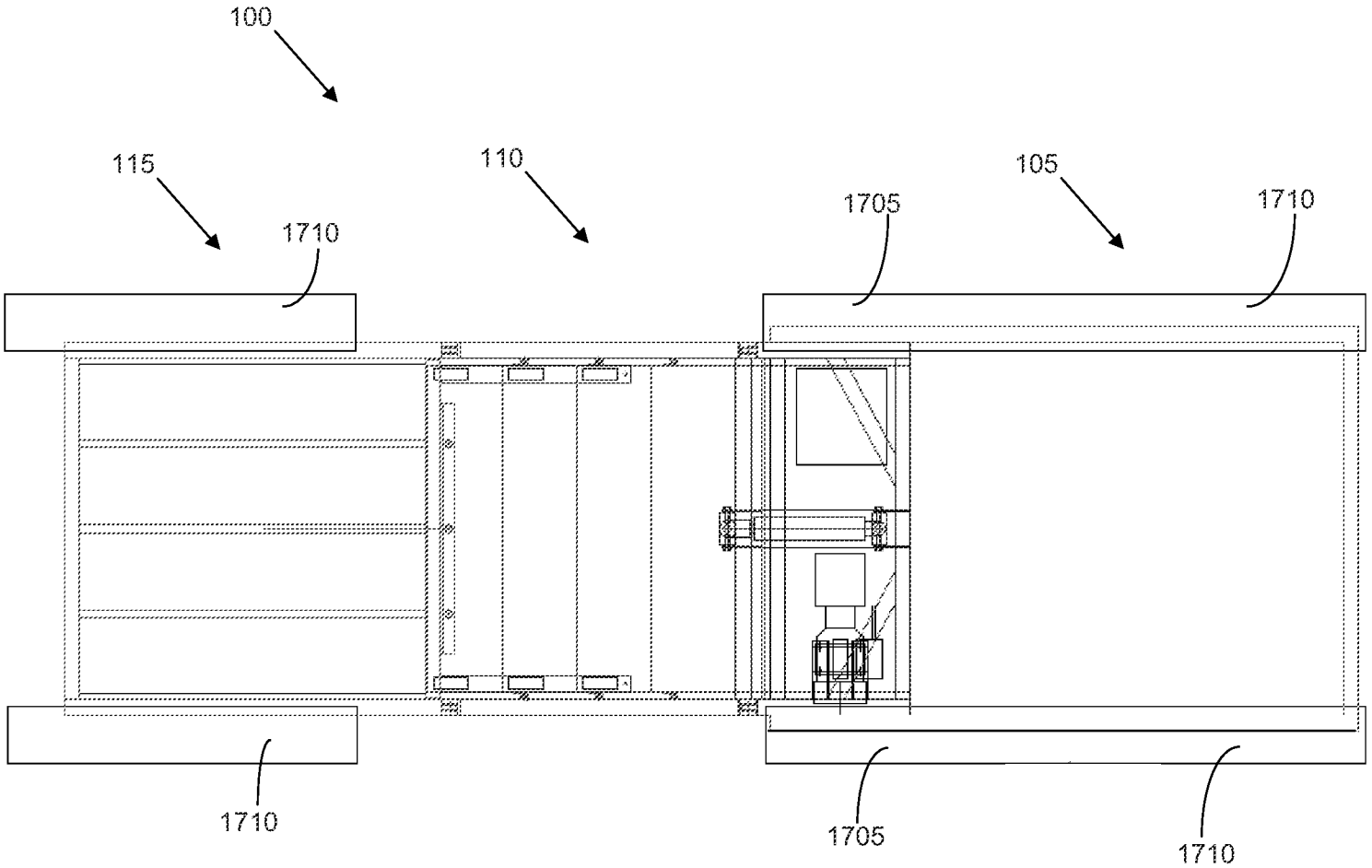
FIG. 20 is a top view of the lift apparatus of FIG. 19.

FIGS. 17-20 illustrate lift apparatus 100 of FIG. 2 mounted to alternate structures. FIG. 17 shows lift apparatus 100 mounted to a first alternate structure 1600. FIG. 18 is a top view of FIG. 17. FIG. 19 shows lift apparatus 100 mounted to a second alternate structure 1700. FIG. 20 is a top view of FIG. 19. In the example embodiment of FIGS. 17-18, lift apparatus 100 is generally shown entirely positioned to cement footing 1605. Example support frame structure 1610 is incorporated within landing section 105 and linkage section 110. Support frame structure 1610 is anchored to cement footing 1605 by anchors 1615*a-b*. In the example embodiment of FIGS. 19-20, landing section 105 of lift apparatus 100 is positioned to first cement slab 1705. Platform section 115 of lift apparatus 100 is positioned to second cement slab 1710. Example support frame structure 1715 is incorporated within landing section 105 and anchored to first cement footing by anchors 1720*a-b*. In general, lift apparatus 100 may generally be incorporated directly into the architecture of any public, commercial, or residential building as desired in tandem with structural footings and supporting frame structure. Additionally, lift apparatus 100 is customizable with respect to style and construction and are arranged configured such as to conform to codes and standards where required.

Figure 21:
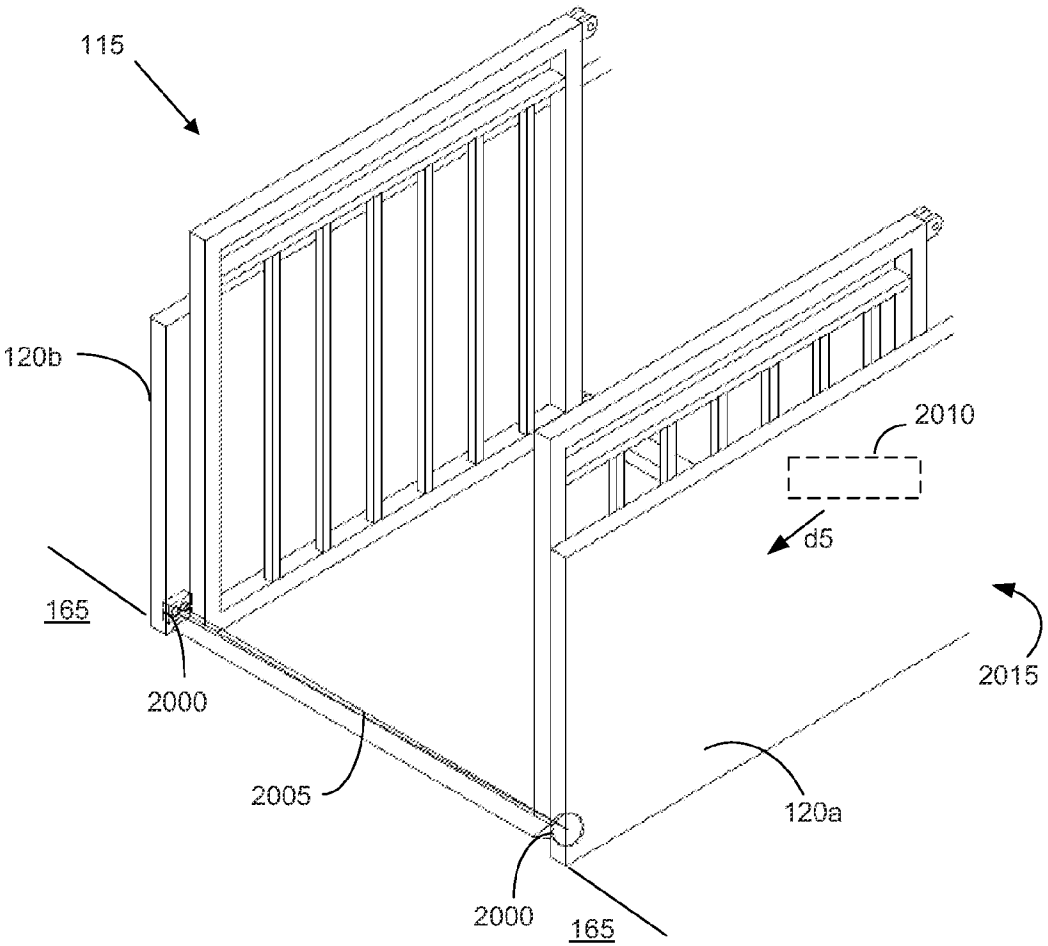
FIG. 21 shows the platform section of the lift apparatus of FIG. 1 including an intrusion sensing mechanism incorporated within.

FIG. 21 illustrates platform section 115 of FIG. 1 including an intrusion sensing mechanism to detect movement near platform section 115. For example, in some embodiments, platform section 115 includes first intrusion sensor 2000 at the front edge of the side panels 120*a-b* that observes beam

2005. Other embodiments include second intrusion sensor 2010 positioned internal to linkage section 110 (depicted in FIG. 21 as an intermittent line) beneath step plates 405 of linkage section 110 at end 2015 opposite of intrusion sensor 2010 to detect motion in direction d5. In some embodiments, first intrusion sensor 2000 and second intrusion sensor 2010 are activated when platform section 115 is initially raised from the first position 200 to the second position 205. In some embodiments, once passenger platform 145 is raised above support surface 165, first intrusion sensor 2000 and second intrusion sensor 2010 are activated such that movement in front of example lift apparatus 100 will trigger at least one of first intrusion sensor 2000 and second intrusion sensor 2010. In some embodiments, triggering of either first intrusion sensor 2000 and second intrusion sensor 2010 triggers a cue, such as for example a visual cue or an audio cue, that is communicated to a passenger of lift apparatus 100. In example embodiments, such a cue may warn the passenger that someone or something is too close to lift apparatus 100 and movement of platform section 115 ceases until the situation is resolved. In some embodiments, the cue will be maintained until platform section 115 is lowered back to support surface 165 in which the at least one of first intrusion sensor 2000 and second intrusion sensor 2010 is deactivated.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A lift apparatus comprising:

a stationary landing section including an elevated landing, at least one support member extending from the stationary landing section, and step supports rigidly coupled to the at least one support member, wherein the step supports are stationary relative to the at least one support member;

a platform section including a passenger platform constructed to move between a first position and an elevated second position; and a linkage section pivotally connected to and arranged between the platform section and the landing section, wherein the linkage section comprises a linkage and step plates pivotally and directly connected to the linkage, wherein when the platform section is in the first position, at least some of the step plates are supported by the step supports to form a stairway, and wherein when the platform section is in the second position, the step plates are pivoted relative to the linkage to collectively form a surface extending between the platform section and the elevated landing; wherein the stationary landing section further comprises an extended landing surface forming a top step of the lift apparatus, and wherein the extended landing surface is positioned approximately level to a height of the elevated second position; and wherein the linkage section further comprises a plurality of flexible panels, and wherein at least one of the plurality flexible panels is hingedly coupled to a corresponding one of the plurality of step plates and the extended landing surface.

2. The lift apparatus of claim 1, wherein a first end of an actuator is pivotally coupled to the stationary landing section and a second end of the actuator is pivotally coupled to the linkage, and wherein the actuator is configured to actuate the passenger platform between the first position and the elevated second position.

3. The lift apparatus of claim 2, further comprising an actuator control and an electrical control configured to control the actuator configured to actuate the passenger platform between the first position and the elevated second position.

4. The lift apparatus of claim 1, wherein the platform section further comprises a platform railing constructed from a plurality of rails and upright members.

5. The lift apparatus of claim 4, further comprising a gate connected to the platform railing, and wherein the gate comprises an actuation mechanism that actuates the gate to an open position when the passenger platform section is in the first position and otherwise actuates the gate to a closed position.

6. The lift apparatus of claim 1, wherein each of the stationary landing section and the platform section are hingedly connected to the linkage section at a plurality of pivot points.

7. The lift apparatus of claim 6, wherein a bushing assembly is incorporated within each of the plurality of pivot points, wherein the bushing assembly comprises a spherical bearing positioned with a rod, and wherein the rod is pivotally coupled to a yoke.

8. The lift apparatus of claim 1, wherein the stationary landing section further comprises a landing railing constructed from a plurality of rails and upright members.

9. The lift apparatus of claim 1, wherein the steps plates are secured within the linkage by gravity when the passenger platform is in the elevated second position.

10. The lift apparatus of claim 1, wherein the plurality flexible panels obstruct view of the first and second plurality of step supports when the passenger platform is in the first position and hang below the horizontal surface when the passenger platform is in the elevated second position.

11. The lift apparatus of claim 1, wherein the passenger platform is formed from expanded metal.

12. The lift apparatus of claim 1, further comprising one or more intrusion sensors configured to sense an intrusion and alert an operator of the lift apparatus when the passenger platform is actuated between the first position and the elevated second position.

13. The lift apparatus of claim 1, wherein when the platform section is in the first position, bottom surfaces of the at least some of the step plates are in direct contact with surfaces of at least some of the step supports.

* * * * *